US011236927B2

(12) United States Patent
Kimata et al.

(10) Patent No.: US 11,236,927 B2
(45) Date of Patent: Feb. 1, 2022

(54) INDOOR SYSTEM AND INDOOR UNIT OF AIR-CONDITIONING APPARATUS

(71) Applicant: Mitsubishi Electric Corporation, Tokyo (JP)

(72) Inventors: Atsushi Kimata, Tokyo (JP); Makoto Kurihara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/962,685

(22) PCT Filed: Feb. 23, 2018

(86) PCT No.: PCT/JP2018/006776

§ 371 (c)(1),
(2) Date: Jul. 16, 2020

(87) PCT Pub. No.: WO2019/163104

PCT Pub. Date: Aug. 29, 2019

(65) Prior Publication Data

US 2020/0363092 A1 Nov. 19, 2020

(51) Int. Cl.

| | |
|---|---|
| ***F24F 11/89*** | (2018.01) |
| ***F24F 1/005*** | (2019.01) |
| ***F24F 1/0022*** | (2019.01) |
| ***F24F 13/20*** | (2006.01) |

(52) U.S. Cl.

CPC ..... *F24F 11/89* (2018.01); *F24F 1/005* (2019.02); *F24F 1/0022* (2013.01); *F24F 13/20* (2013.01); *F24F 2013/207* (2013.01)

(58) Field of Classification Search

CPC ..... F24F 11/89; F24F 1/0047; F24F 13/20; F24F 2013/207

See application file for complete search history.

(56) References Cited

U.S. PATENT DOCUMENTS

| | | | | |
|---|---|---|---|---|
| 2009/0205352 | A1 | 8/2009 | Choi et al. | |
| 2016/0363338 | A1* | 12/2016 | Yamane | F24F 11/62 |
| 2019/0383509 | A1* | 12/2019 | Takagi | F25B 1/00 |

FOREIGN PATENT DOCUMENTS

| | | | |
|---|---|---|---|
| EP | 3 457 043 | A1 | 3/2019 |
| JP | 2002-081722 | A | 3/2002 |
| JP | 2002-081723 | A | 3/2002 |
| JP | 2004-251545 | A | 9/2004 |

(Continued)

OTHER PUBLICATIONS

International Search Report of the International Searching Authority dated May 15, 2018 for the corresponding international application No. PCT/JP2018/006776 (and English translation).

(Continued)

*Primary Examiner* — Nelson J Nieves
(74) *Attorney, Agent, or Firm* — Posz Law Group, PLC

(57) ABSTRACT

An indoor unit of an air-conditioning apparatus includes a main body including a main board that is provided with a control terminal compatible with a plurality of expansion units. The main board is connected to an expansion board provided with at least one expansion terminal that is a connection terminal compliant with the same standard as the control terminal, and is connected to at least one of the plurality of expansion units via the expansion board.

6 Claims, 12 Drawing Sheets

(56) References Cited

FOREIGN PATENT DOCUMENTS

| | | | | | |
|---|---|---|---|---|---|
| JP | 2005-016801 | A | | 1/2005 | |
| JP | 2012-117729 | A | | 6/2012 | |
| JP | 2012-120309 | A | | 6/2012 | |
| JP | 2014115019 | A | * | 6/2014 | ..... F24F 7/06 |
| JP | 2017-180996 | A | | 10/2017 | |
| WO | 2017/195365 | A1 | | 11/2017 | |

OTHER PUBLICATIONS

Chinese Office Action dated Mar. 26, 2021, issued in corresponding CN Patent Application No. 201880086961.5 (and English Machine Translation).

Extended European Search Report dated Feb. 1, 2021, issued in corresponding European patent application 18906902.4.

Japanese Office Action dated Mar. 16, 2021, issued in corresponding Japanese patent application 2020-501963 (and English machine translation).

Office Action dated Sep. 18, 2021, issued in corresponding CN Patent Application No. 201880086961.5 (and English Machine Translation).

* cited by examiner

INDOOR SYSTEM AND INDOOR UNIT OF AIR-CONDITIONING APPARATUS

CROSS REFERENCE TO RELATED APPLICATION

This application is a U.S. national stage application of International Application No. PCT/JP2018/006776, filed on Feb. 23, 2018, the contents of which are incorporated herein by reference.

TECHNICAL FIELD

The present disclosure relates to an indoor system and an indoor unit of the air-conditioning apparatus that adjusts an air environment of an air-conditioned space.

BACKGROUND

Indoor units of existing air-conditioning apparatuses have a basic function of sucking air through an air inlet to cause the air to pass through a heat exchanger and blowing through an air outlet, the air that has passed through the heat exchanger. Furthermore, indoor units of some recent air-conditioning apparatuses have additional functions along with the basic function. In an indoor unit described in Patent Literature 1, a main board and a plurality of drive boards are provided in a housing of a main body. On the main board, electrical components for the basic function are mounted, and on the drive boards, electrical components for the additional functions are mounted.

PATENT LITERATURE

Patent Literature 1: Japanese Unexamined Patent Application Publication No. 2004-251545

In the indoor unit described in Patent Literature 1, the drive boards are connected to the main board by respective signal lines. The main board thus needs to have a plurality of connection terminals that allow the drive boards to be connected to the main board. Therefore, the main board is made larger. In the case where the indoor unit of Patent Literature 1 is configured such that the additional functions are controlled by a microcomputer on the main board, the main board needs to have a plurality of connection terminals for use in giving instructions to the respective drive boards. Inevitably, the main board is made larger.

SUMMARY

The present disclosure is applied to solve the above problem, and relates to an indoor system and an indoor unit of an air-conditioning apparatus in which a main board is prevented from being made larger.

An indoor unit of an air-conditioning apparatus according to an embodiment of the present disclosure includes a main body including a main board that is provided with a control terminal compatible with a plurality of expansion units. The main board is connected to an expansion board provided with at least one expansion terminal that is a connection terminal compliant with the same standard as the control terminal, and is connected to at least one of the plurality of expansion units via the expansion board.

An indoor system according to the embodiment of the present disclosure includes the above indoor unit of the air-conditioning apparatus and a board unit including a board case. The expansion board is housed in the board case.

According to the embodiment of the present disclosure, the main board can be connected to the expansion units via the expansion board. The main board does not need to have a plurality of connection terminals for connection to the respective expansion units. Therefore, the main board is prevented from being made larger.

DETAILED DESCRIPTION

Embodiment 1

Figure 1:
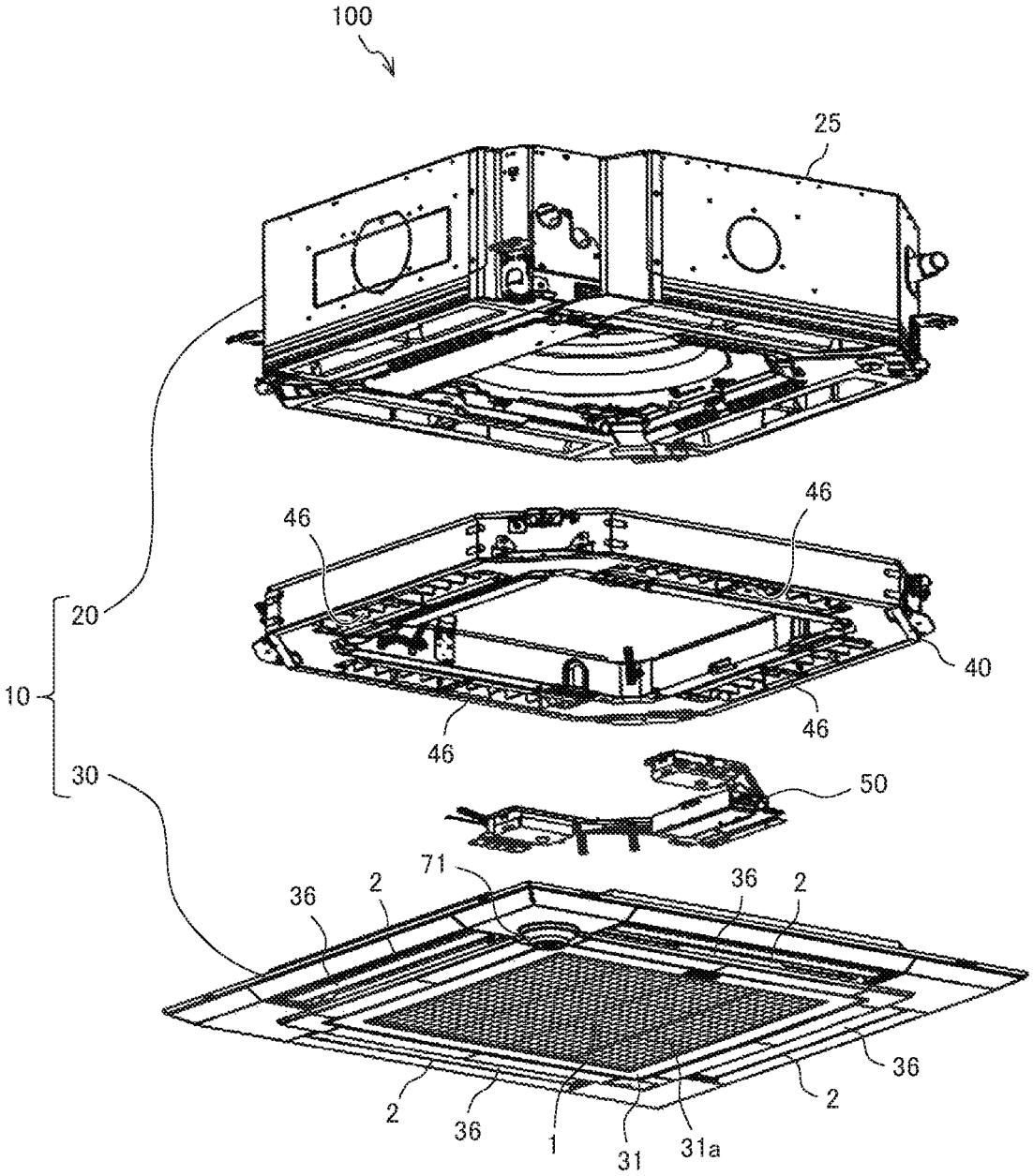
FIG. 1 is an exploded perspective view of an exemplary appearance of an indoor system including an indoor unit of an air-conditioning apparatus according to Embodiment 1 of the present disclosure.
Figure 2:
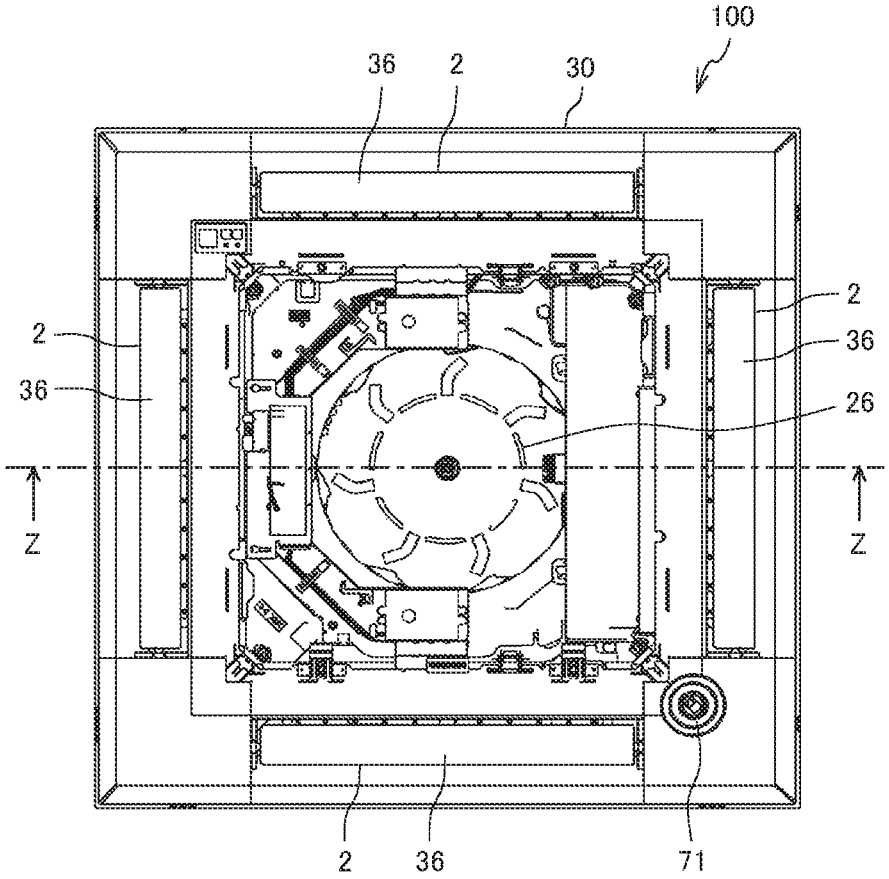
FIG. 2 is a bottom view of the indoor system as illustrated in FIG. 1 in which components are connected to each other, as viewed from a decorative-panel side.
Figure 3:
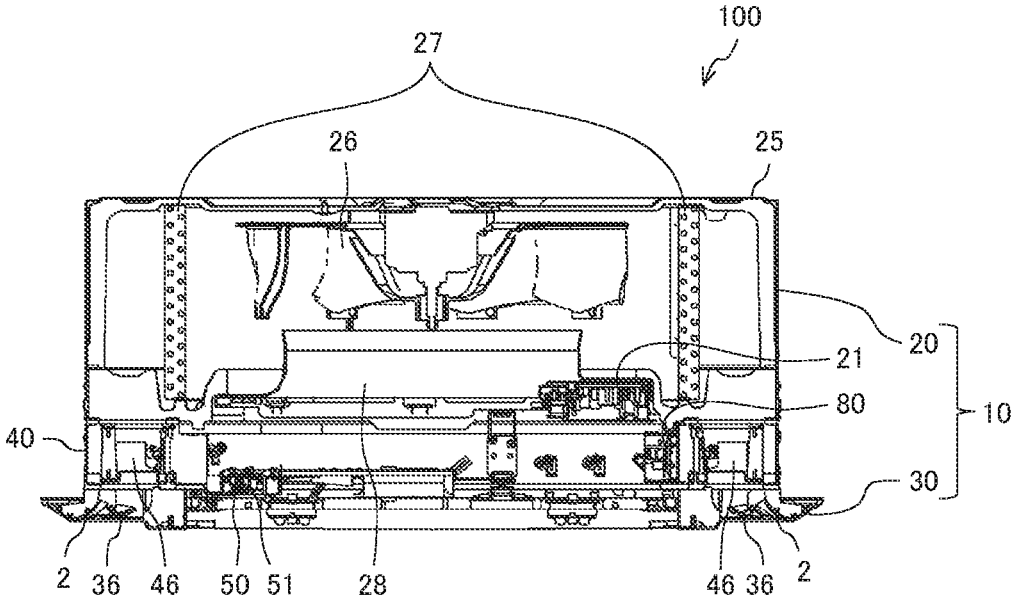
FIG. 3 is a schematic sectional view taken along line Z-Z in FIG. 2.

FIG. 1 is an exploded perspective view of an appearance of an indoor system and an indoor unit of an air-conditioning apparatus according to Embodiment 1 of the present disclosure. FIG. 2 is a bottom view of the indoor system as illustrated in FIG. 1, in which components are connected to each other, as viewed from a decorative-panel side. FIG. 3 is a schematic sectional view taken along line Z-Z in FIG. 2. An overall configuration of the indoor system and the indoor unit of the air-conditioning apparatus according to Embodiment 1 will be described with reference to FIGS. 1 to 3.

An indoor system 100 according to Embodiment 1 includes an indoor unit 10 of an air-conditioning apparatus, an expansion unit 40, and an expansion unit 50. That is, the indoor system 100 and an outdoor unit including a compressor (not illustrated) form the air-conditioning apparatus. In Embodiment 1, the indoor unit 10 is installed in such a manner as to be concealed in a ceiling in an air-conditioned space such as the ceiling of a room, or to be suspended from the ceiling in the air-conditioned space. The indoor unit 10 includes a main body 20 and a decorative panel 30.

The decorative panel 30 has an air inlet 1 and air outlets 2 in its lower surface. The air inlet 1 is located in central part of the lower surface of the decorative panel 30. At the air inlet 1, an air inlet grille 31 is provided. At the air inlet grille 31, a filter 31*a* that collects dust floating in air is provided. FIG. 2 illustrates the indoor system, with the air inlet grille 31 removed.

FIGS. 1 and 2 illustrate by way of example a configuration in which the decorative panel 30 has four air outlets 2. The four air outlets 2 are arranged on four sides of the air inlet 1 in such a manner as to surround the air inlet 1. To be more specific, the filter 31*a* is located at center part of an area surrounded by the four air outlets. The air outlets 2 are each rectangular and arranged such that long sides of the air outlets extend along respective sides of the lower surface of the decorative panel 30.

The main body 20 includes a casing 25, which is a hollow cuboid box and serves as a shell. In the casing 25 of the main body 20, a fan 26 is provided. The fan 26 is a centrifugal fan such as a turbo fan. The fan 26 is located to face the air inlet 1. The fan 26 causes air in the air-conditioned space to be sucked into the casing 25 through the air inlet 1 and to be blown through the air outlets 2. The main body 20 further includes a bell mouth 28 that guides the air sucked through the air inlet 1 to the fan 26, and that is located under the fan 26.

The main body 20 further includes a heat exchanger 27, which is a fin-and-tube heat exchanger, for example. The heat exchanger 27 is connected to the above compressor by a refrigerant pipe, whereby a refrigerant circuit is provided. In the casing 25, the heat exchanger 27 is provided in such a manner as to surround the fan 26. That is, the heat exchanger 27 is located outward of the air inlet 1 and inward of the air outlets 2 as viewed in plan view. The heat exchanger 27 causes heat exchange to be performed between refrigerant that flows in the heat exchanger 27 and air that is sucked into the casing 25 by the fan 26. Under the heat exchanger 27, a drain pan is provided to receive condensation water that is generated from a surface of the heat exchanger 27.

In the indoor system 100, an air inlet passage and air outlet passages are provided. Through the air inlet, the air inlet 1 communicates with the heat exchanger 27, and through the air outlet passages, the heat exchanger 27 communicates with the air outlets 2. As illustrated in FIG. 3, the indoor system 100 includes the main body 20, the expansion unit 40, the expansion unit 50, and the decorative panel 30, which are joined together. The air inlet passage extends from the air inlet 1 in the decorative panel 30 to the main body 20 through the expansion unit 50 and the expansion unit 40. The air outlet passage extends from the heat exchanger 27 in the main body 20 to the air outlets 2 in the decorative panel 30 through the expansion units 40 and 50.

At the air outlets 2 in the decorative panel 30, respective vertical air-flow-direction adjusting vanes 36 are provided swingable to adjust in a vertical direction, the angle of air that is blown from the air outlet 2. Each of the vertical air-flow-direction adjusting vanes 36 is a plate-like element that extends in a longitudinal direction of an associated one of the air outlet passages. Each vertical air-flow-direction adjusting vane 36 is driven by a vertical drive motor 37, which will be described later, and is swung about an axis of rotation that extends in the longitudinal direction of the associated air outlet passage.

At the decorative panel 30 in Embodiment 1, a Move-Eye sensor 71 including an infrared sensor is provided. The infrared sensor detects radiation temperatures in the air-conditioned space. In the Move-Eye sensor 71, the infrared sensor can be rotated in a circumferential direction by a drive unit (not illustrated). The drive unit for the Move-Eye sensor 71 is controlled by a controller 24, which will be described later. When making one full turn in the circumferential direction, the infrared sensor of the Move-Eye sensor 71 detects radiation temperatures in the entire air-conditioned space. The main body 20 in Embodiment 1 further includes a temperature sensor 72 (see FIG. 8) that detects the temperature of air that is sucked into the casing 25 through the air inlet 1 and a humidity sensor 73 (see FIG. 8) that detects the humidity of the air that is sucked into the casing 25 through the air inlet 1.

In Embodiment 1, a blowing unit is provided as an example of the expansion unit 40. The blowing unit is located between the casing 25 of the main body 20 and the decorative panel 30. The expansion unit 40 includes four lateral air-flow-direction adjusting members 46, and the number of the lateral air-flow-direction adjusting members 46 is equal to that of the air outlets 2.

The four lateral air-flow-direction adjusting members 46 are provided in the respective air outlet passages in the expansion unit 40 such that the lateral air-flow-direction adjusting members 46 are swingable and associated with respective air outlets, that is, the four air outlets 2. Each of the lateral air-flow-direction adjusting members 46 adjusts in a lateral direction, the angle of air that is blown from the air outlet 2. Each lateral air flow direction adjusting member 46 includes a plurality of plate-like vanes arranged at regular intervals and coupled by a coupling member. In the lateral air-flow-direction adjusting member 46, when a driving force from a lateral driving motor 47, which will be described later, is transmitted to the coupling member, the plate-like vanes are reciprocated in the lateral direction.

In Embodiment 1, a lifting unit that is attached to the decorative panel 30 and automatically moves the air inlet grille 31 up and down is provided as an example of the expansion unit 50. The expansion unit 50 will be described in detail later.

Figure 4:
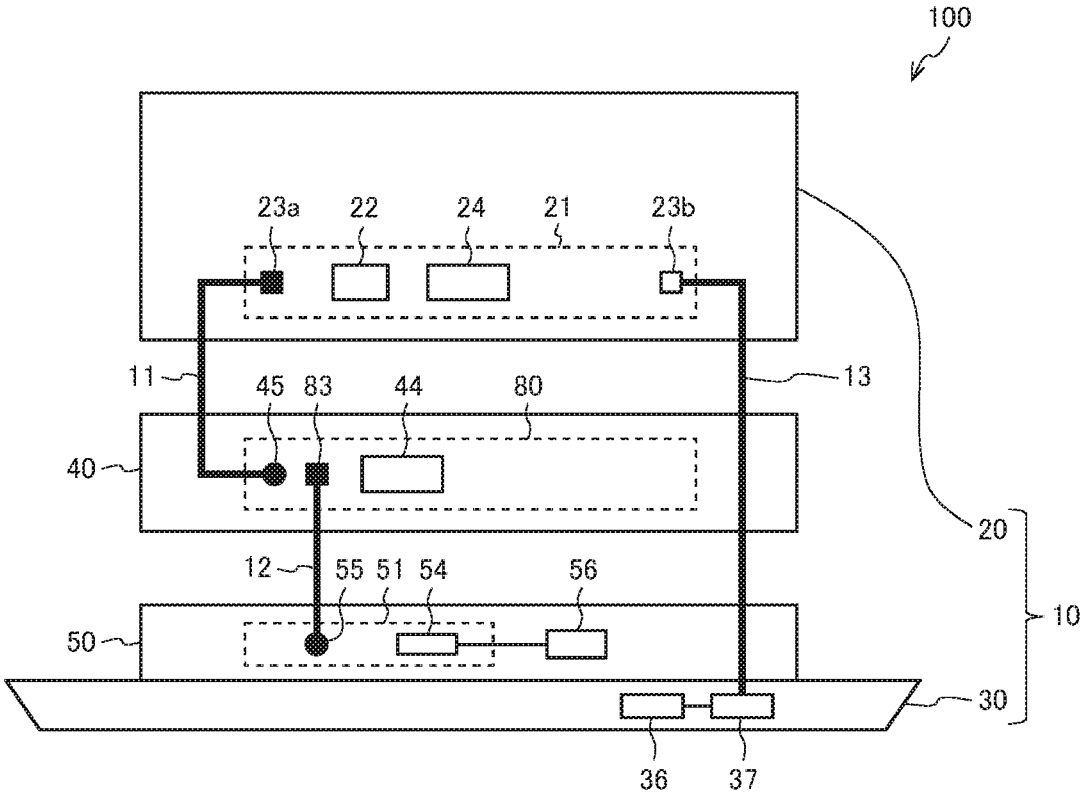
FIG. 4 is a configuration diagram indicating a connection relationship in the indoor system as illustrated in FIG. 1.
Figure 5:
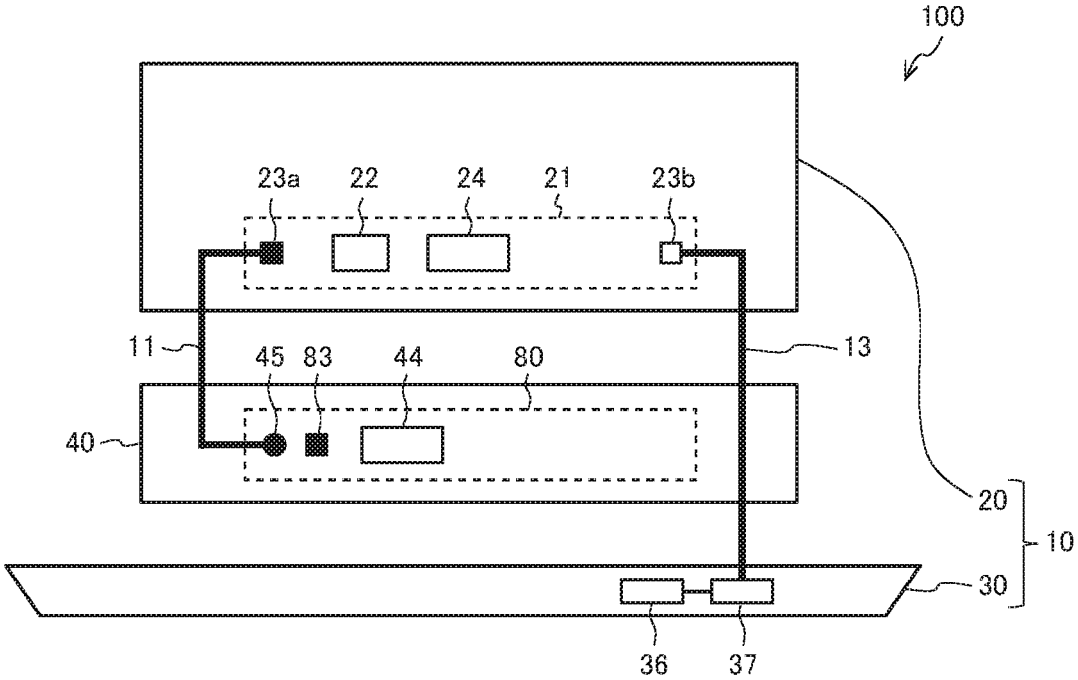
FIG. 5 is a configuration diagram of an example of the indoor system in which an expansion unit is attached to the indoor unit as illustrated in FIG. 1.
Figure 6:
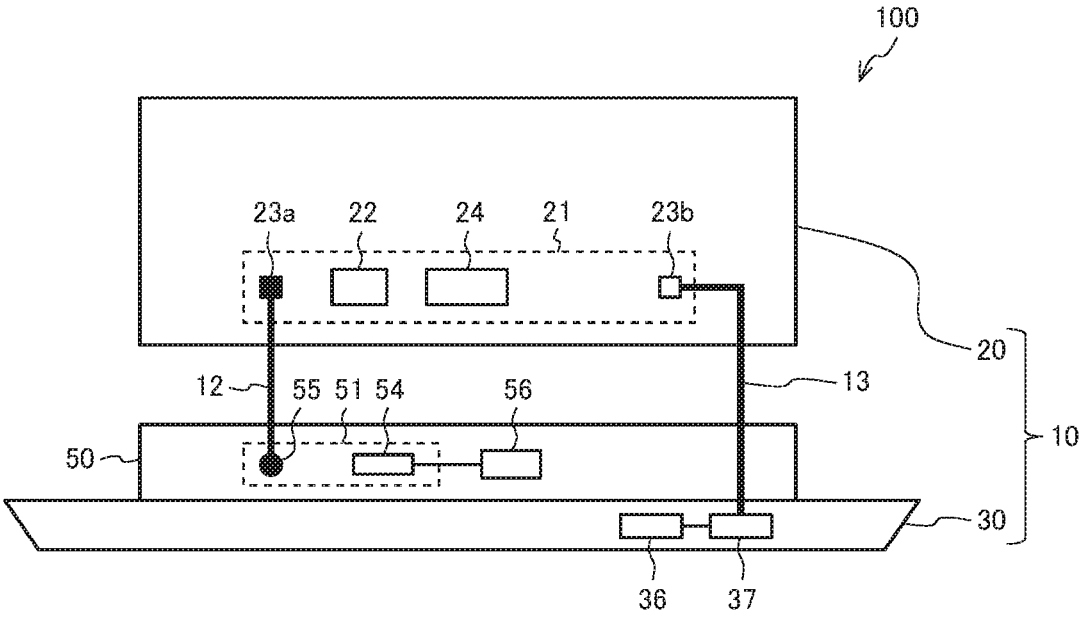
FIG. 6 is a configuration diagram of an example of the indoor system in which another expansion unit is attached to the indoor unit as illustrated in FIG. 1.
Figure 7:
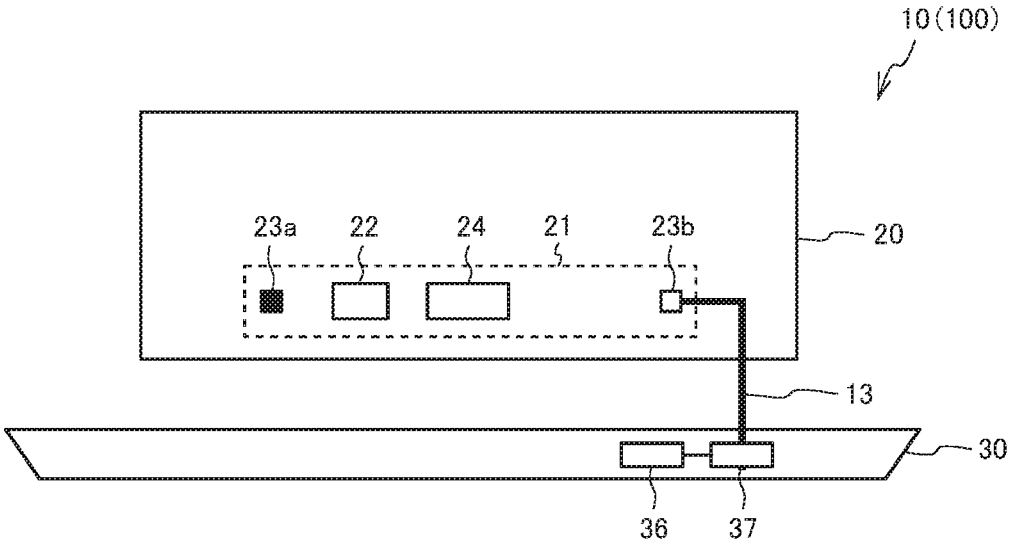
FIG. 7 is a configuration diagram indicating a connection relationship in the indoor unit as illustrated in FIG. 1.

FIG. 4 is a configuration diagram indicating a connection relationship in the indoor system as illustrated in FIG. 1. FIG. 5 is a configuration diagram of an example of the indoor system in which an expansion unit is attached to the indoor unit as illustrated in FIG. 1. FIG. 6 is a configuration diagram of an example of the indoor system in which another expansion unit is attached to the indoor unit as illustrated in FIG. 1. FIG. 7 is a configuration diagram indicating a connection relationship in the indoor unit as illustrated in FIG. 1.

As illustrated in FIGS. 4 to 6, the main body 20 can be directly or indirectly connected to various expansion units. In Embodiment 1, the expansion unit 40, which is the blowing unit, and the expansion unit 50, which is the lifting unit, are illustrated as examples of the expansion units that are connected to the main body 20.

Therefore, four connection patterns in the indoor unit 100 are illustrated in FIGS. 4 to 7. FIG. 4 is associated with the configuration as illustrated in FIGS. 1 to 3. FIG. 7 illustrates the case where neither the expansion unit 40 nor the expansion unit 50 is connected to the main body 20. The decorative panel 30 is connected as an essential component of the indoor unit 10, to the main body 20.

Outlines of components and a connection relationship between boards, etc., will be described with reference to FIG. 4. As illustrated in FIG. 4, the main body 20 includes a main board 21 that controls the indoor system 100 in a centralized manner. The main board 21 includes a power supply circuit 22, a control terminal 23*a*, a drive terminal 23*b*, and the controller 24. The control terminal 23*a* and the drive terminal 23*b* are included in a terminal unit 23.

The outdoor unit, which is included together with the indoor unit 10 in the air-conditioning apparatus, includes an outdoor control unit that controls various actuators in the outdoor unit. The controller 24 transmits a control signal to and receives a control signal from the outdoor control unit. That is, the air-conditioning apparatus is controlled by the controller 24 and the outdoor control unit that operates in cooperation with each other. The control terminal 23*a* is a connection terminal compatible with the expansion unit 40 and the expansion unit 50. That is, the expansion units 40 and 50 are devices compliant with a standard of the control terminal 23*a*.

The power supply circuit 22 is a direct current (DC) power supply circuit that is connected to, for example, a commercial power source, and converts an alternating current power supply supplied from the commercial power source to a DC power supply. The power supply circuit 22 supplies power to an expansion unit connected to the main board 21. To be more specific, the power supply circuit 22 generates not only power required to drive the main body 20 and the decorative panel 30, but power required to drive the expansion unit 40 and the expansion unit 50. In Embodiment 1, power generated in the power supply circuit 22 is supplied to an expansion board 80 in the expansion unit 40 and a standard board 51 in the expansion unit 50.

The expansion unit 40 includes the expansion board 80 provided with at least one expansion terminal 83 that is a connection terminal compliant with the same standard as the control terminal 23*a*. That is, the expansion units 40 and 50 are also compliant with the standard of the expansion terminal 83. The expansion board 80 as illustrated in FIG. 4 is provided with one expansion terminal 83. Furthermore, the expansion board 80 includes a drive processing unit 44 and an input terminal 45. The drive processing unit 44 drives the lateral driving motor 47 in response to an operation instruction from an operation instruction unit 24*b*, thereby operating the lateral air-flow-direction adjusting members 46.

Furthermore, the expansion board 80 has a relay function of transferring an operation instruction from the controller 24 to an expansion unit. To be more specific, the drive processing unit 44 has a function of determining whether the operation instruction from the controller 24 is an operation instruction for the expansion unit 40 or an operation instruction for the expansion unit 50, and transferring the operation instruction for the expansion unit 50 to the expansion unit 50.

The expansion unit 50 includes the standard board 51 that includes a drive processing unit 54 and an input terminal 55, and that fulfills a standard function of the expansion unit 50. In Embodiment 1, the standard function of the expansion unit 50 is a function of moving the air inlet grille 31 up and down. Furthermore, the expansion unit 50 includes a lifting mechanism 56, which is driven by the drive processing unit 54.

The lifting mechanism 56 includes wires, spools, and lifting drive motors, which are not illustrated. The wires are connected to, for example, the air inlet grille 31 at respective positions, the spools are wound with the wires, and the lifting drive motors rotate the spools. The lifting drive motors operate to unwind the wires wound on the spools or wind the wires around the spools. The drive processing unit 54 drives the lifting mechanism 56 in response to an operation instruction from the operation instruction unit 24*b*, thereby moving the air inlet grille 31 up or down.

In the case illustrated in FIG. 4, the control terminal 23*a* is connected to the input terminal 45 by a wiring line 11, and the expansion terminal 83 is connected to the input terminal 55 by a wiring line 12, and the drive terminal 23*b* is connected to the vertical drive motor 37 by a wiring line 13. The main board 21 is connected to the expansion unit 50 via the expansion board 80 in the above manner.

That is, the main board 21 is connected to the expansion unit 50 via the expansion board 80 by the following connections: the wiring line 11 that extends from the expansion board 80 is connected to the control terminal 23*a*; and the wiring line 12 that extends from the expansion unit 50 including no expansion board 80 is connected to the expansion terminal 83. In this case, the power supply circuit 22 supplies power to the expansion unit 40 through the wiring line 11, and supplies power to the expansion unit 50 through the wiring lines 11 and 12.

The controller 24 has a function of detecting where or not the main body 20 is connected to each of the expansion unit 40 and the expansion unit 50. As illustrated in FIG. 4, in the case where the wiring line 11 is connected to the control terminal 23*a* and the wiring line 12 is connected to the expansion terminal 83, the controller 24 transmits an operation instruction for the expansion unit 40 and an operation instruction for the expansion unit 50 to the expansion unit 40 including the expansion board 80.

As illustrated in FIG. 5, in the case where only the expansion unit 40 is connected to the main body 20, that is, in the case where only the expansion unit 40 including the expansion board 80 is connected to the main board 21, the controller 24 transmits an operation instruction to the expansion unit 40 only. In this case, the power supply circuit 22 supplies power to the expansion unit 40 through the wiring line 11.

As illustrated in FIG. 6, in the case where only the expansion unit 50 is connected to the main body 20, that is, in the case where the wiring line 12 extending from the expansion unit 50 including no expansion board 80 is connected to the control terminal 23*a*, the controller 24 directly transmits an operation instruction to the expansion unit 50. Unlike the case as illustrated in FIG. 4, in the case as illustrated in FIG. 6, the wiring line 12 extending from the input terminal 55 of the expansion unit 50 is directly connected to the control terminal 23*a*. Therefore, the power supply circuit 22 supplies power to the expansion unit 50 through the wiring line 12.

In the case of adopting each of the configurations as illustrated in FIGS. 4 to 6, since the number of terminals provided at the main board 21 can be reduced to the minimum, the main board 21 is not made larger. Also, in the case where the indoor unit 10 is used with no expansion unit as illustrated in FIG. 7, since the space in the main board 21 is increased only by space for the control terminal 23*a*, that is, for a single control terminal, it is possible to reduce the degree to which the size of the main board 21 is increased.

Figure 8:
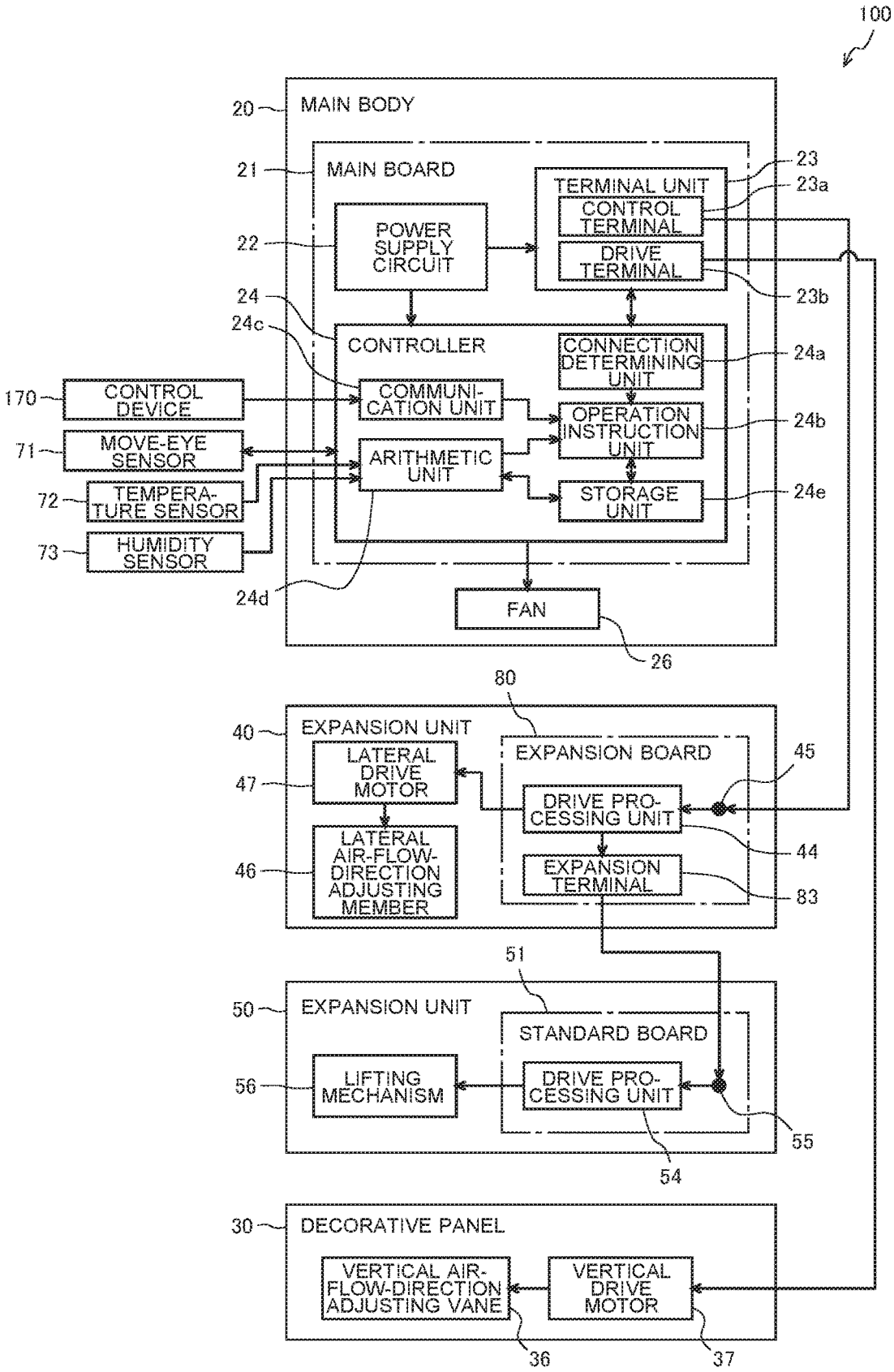
FIG. 8 is a block diagram of a functional configuration of the indoor system as illustrated in FIG. 1.

FIG. 8 is a block diagram of a functional configuration of the indoor system as illustrated in FIG. 1. As illustrated in FIG. 8, the controller 24 includes a connection determining unit 24*a*, the operation instruction unit 24*b*, a communication unit 24*c*, an arithmetic unit 24*d*, and a storage unit 24*e*. The connection determining unit 24*a* monitors the terminal unit 23 to detect whether or not the main body 20 is connected to each of a plurality of expansion units, that is, a connection state of the main body 20.

In the configuration as illustrated in FIG. 8, the connection determining unit 24*a* detects whether or not the main body 20 is connected to each of the expansion unit 40 and the expansion unit 50. In Embodiment 1, at turn-on, that is, when the indoor system 100 is turned on, the connection determining unit 24*a* determines which of the four connection states as illustrated in FIGS. 4 to 7 is set as the connection state of the main body 20. To be more specific, the connection determining unit 24*a* determines, at turn-on, a connection state between the main body 20 and each of the expansion unit 40 and the expansion unit 50. The connection determining unit 24*a* outputs connection-state data indicating the result of the above determination to the operation instruction unit 24*b*.

The communication unit 24*c* communicates with a control device 170, and transfers an operation signal transmitted from the control device 170 to the operation instruction unit 24*b*. It should be noted that the control device 170 is, for example, a remote control unit for use in operating and managing the indoor system 100 or a central controller that manages the air-conditioning apparatus including the indoor system 100 in a centralized manner. The control device 170 is connected to the communication unit 24*c* by a wiring line or wirelessly. Using the control device 170, a user can set operating conditions of the air-conditioning apparatus, and change settings of the air-conditioning apparatus. More specifically, the control device 170 receives an instruction regarding an operation of setting or changing an air flow direction, an air flow rate, a target temperature, etc., and transmits an operation signal indicating details of the operation to the communication unit 24*c*.

The arithmetic unit 24*d* acquires detection data from various sensors, for example, the Move-Eye sensor 71, the temperature sensor 72, and the humidity sensor 73, and performs arithmetic operations for air-conditioning control on the basis of the acquired detection data. For example, the arithmetic unit 24*d* acquires, as detection data from the Move-Eye sensor 71, information indicating radiation temperatures in the air-conditioned space, and performs, for example, processing of detecting, from the entire air-conditioned space, an area having a radiation temperature higher than a reference temperature, thereby detecting the position of a human body in the air-conditioned space. The arithmetic unit 24*d* outputs position information indicating the detected position of the human body to the operation instruction unit 24*b*.

Furthermore, the arithmetic unit 24*d* acquires, as detection data from the temperature sensor 72, information indicating the temperature of air, compares the temperature indicated by the detection data with a reference temperature set in advance, and outputs temperature comparison information indicating the result of the above comparison to the operation instruction unit 24*b*. The reference temperature is, for example, a target temperature set by using, for example, the control device 170. The set value can be changed as appropriate. The arithmetic unit 24*d* acquires, as detection data from the humidity sensor 73, information indicating the humidity of the air, compares the humidity indicated by the detection data with a reference humidity set in advance, and outputs humidity comparison information indicating the result of the comparison to the operation instruction unit 24*b*. The reference humidity is set in advance in consideration of, for example, comfort. The set value can be changed as appropriate.

The operation instruction unit 24*b* determines the system configuration on the basis of the connection-state data, which is output from the connection determining unit 24*a* at turn-on. Then, the operation instruction unit 24*b* controls, based on the determined system configuration, at least one of the fan 26, the expansion unit 40, the expansion unit 50, and the vertical drive motor 37 on the basis of basic settings. It should be noted that the basic settings are settings at the time when, for example, the indoor system 100 was last turned off. The basic settings are not limited to the latest settings, and may be default settings at shipment, for example.

In the system configuration as illustrated in FIG. 4, the operation instruction unit 24*b* controls the fan 26, the expansion unit 40, the expansion unit 50, and the vertical drive motor 37. In the system configuration as illustrated in FIG. 5, the operation instruction unit 24*b* controls the fan 26, the expansion unit 40, and the vertical drive motor 37. In the system configuration as illustrated in FIG. 6, the operation instruction unit 24*b* controls the fan 26, the expansion unit 50, and the vertical drive motor 37. In the system configuration as illustrated in FIG. 7, the operation instruction unit 24*b* controls the fan 26 and the vertical drive motor 37.

The operation instruction unit 24*b* controls the fan 26, the expansion unit 40, the expansion unit 50, and the vertical drive motor 37 on the basis of an operation signal output from the communication unit 24*c*, or on the basis of position information, temperature comparison information, or humidity comparison information that is output from the arithmetic unit 24*d*. Upon receipt of detection data indicating the position of the human body from the Move-Eye sensor 71, the operation instruction unit 24*b* operates at least one of the fan 26, the vertical air-flow-direction adjusting vanes 36, and the lateral air-flow-direction adjusting members 46 such that, for example, air blown from the air outlets 2 is made to flow toward a region covering the position of the human body.

More specifically, the operation instruction unit 24*b* transmits a control signal to the vertical drive motor 37 to cause the vertical drive motor 37 to be driven, thereby operating the vertical air-flow-direction adjusting vanes 36. To operate the lateral air-flow-direction adjusting members 46, the operation instruction unit 24*b* transmits, as an operation instruction, a lateral drive signal for driving the lateral driving motor 47 to the drive processing unit 44 on the expansion board 80 via the control terminal 23*a*. The drive processing unit 44 drives the lateral driving motor 47 in response to the lateral drive signal from the operation instruction unit 24*b*, thereby operating the lateral air-flow-direction adjusting members 46.

Upon receipt of an operation signal indicating an instruction for moving the air inlet grille 31 down or up, from the control device 170, the operation instruction unit 24*b* transmits, as an operation instruction, a lifting drive signal for driving the lifting mechanism 56 to the drive processing unit 44 on the expansion board 80 via the control terminal 23*a*. The drive processing unit 44 transmits the lifting drive signal transmitted from the operation instruction unit 24*b*, to the drive processing unit 54 via the expansion terminal 83. The drive processing unit 54 drives the lifting mechanism 56 in response to the lifting drive signal transmitted from the operation instruction unit 24*b* via the expansion board 80, thereby moving the air inlet grille 31 down or up.

The storage unit 24*e* stores, for example, data indicating the reference temperature and the reference humidity and an operation program for the controller 24. Furthermore, the operation instruction unit 24*b* stores connection-state data indicating the result of determination by the connection determining unit 24*a*, into the storage unit 24*e*. The connection-state data may be stored into the storage unit 24*e* by the connection determining unit 24*a*. In this case, the operation instruction unit 24*b* reads the connection-state data from the storage unit 24*e* to determine a system configuration.

Although it is described above by way of example that two expansion units are provided in the indoor unit 10, it is not limitative. Three or more expansion units may be provided into the indoor unit 10.

Figure 9:
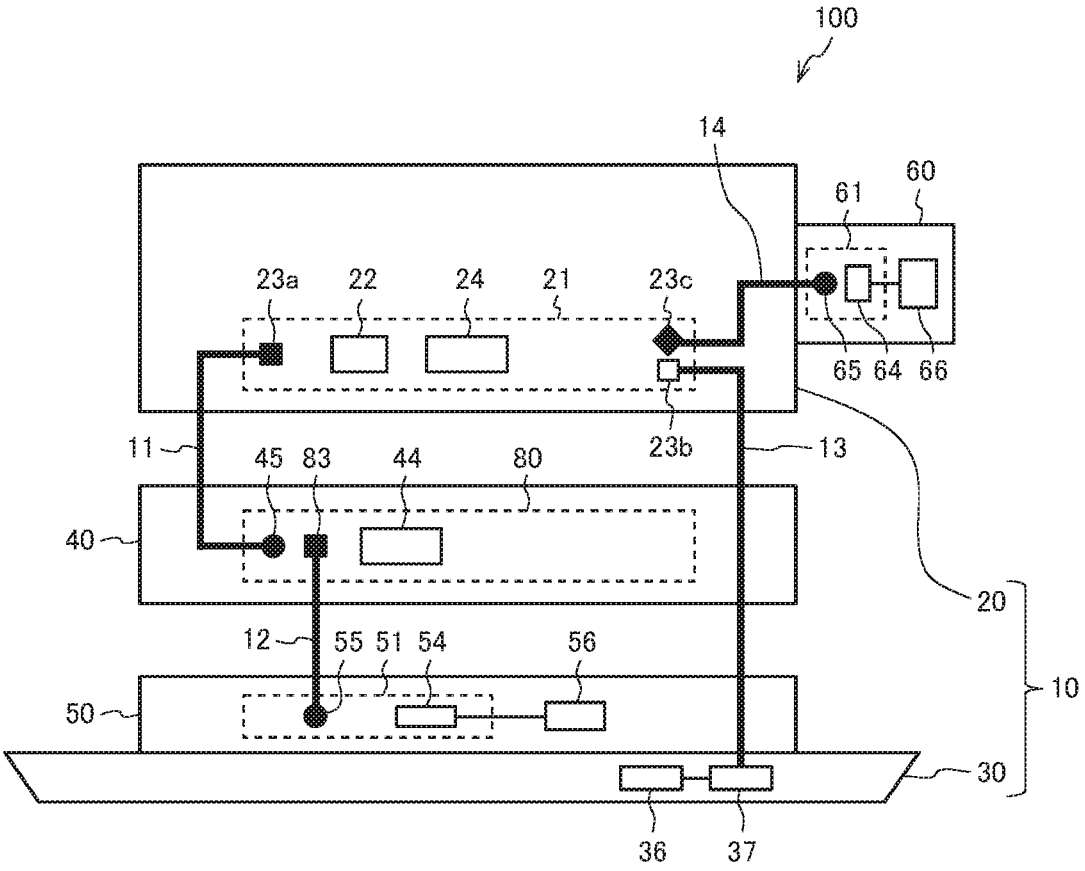
FIG. 9 is a configuration diagram of an example of the indoor system in which a further expansion unit is attached to the indoor unit as illustrated in FIG. 4.

FIG. 9 is a configuration diagram of an example of the indoor system in which a further expansion unit is attached to the indoor unit as illustrated in FIG. 4. FIG. 9 illustrates by way of example a direct-contact humidifier as an expansion unit 60 attached to the indoor unit 10. The expansion unit 60 includes a standard board 61 and a humidifying mechanism 66. The standard board 61 includes a drive processing unit 64 and an input terminal 65. The drive processing unit 64 controls an operation of the humidifying mechanism 66.

In the above example, it is assumed that the expansion unit 60 is not compliant with the standard of the control terminal 23*a* and the expansion terminal 83. The main board 21 includes a control terminal 23*c*, which is included in the terminal unit 23. A wiring line 14 extending from the input terminal 65 is connected to the control terminal 23*c*. The power supply circuit 22 further generates power required to drive the expansion unit 60 and supplies the power to the expansion unit 60 through the wiring line 14.

To operate the expansion unit 60, the operation instruction unit 24*b* transmits, as an operation instruction, a humidification drive signal for driving the humidifying mechanism 66 to the drive processing unit 64 via the control terminal 23*c*. In response to the humidification drive signal from the operation instruction unit 24*b*, the drive processing unit 64 drives the humidifying mechanism 66, thereby adjusting the humidity of air to be blown into the room.

The controller 24, the drive processing unit 44, and the drive processing unit 54 are hardware such as circuit devices that fulfill the functions described above, or an arithmetic device such as a microcomputer, and software that fulfills the above functions in cooperation with the arithmetic device. The storage unit 24*e* is, for example, a random access memory (RAM), a read only memory (ROM), a programmable ROM (PROM) such as a flash memory, or a hard disk drive (HDD).

Figure 10:
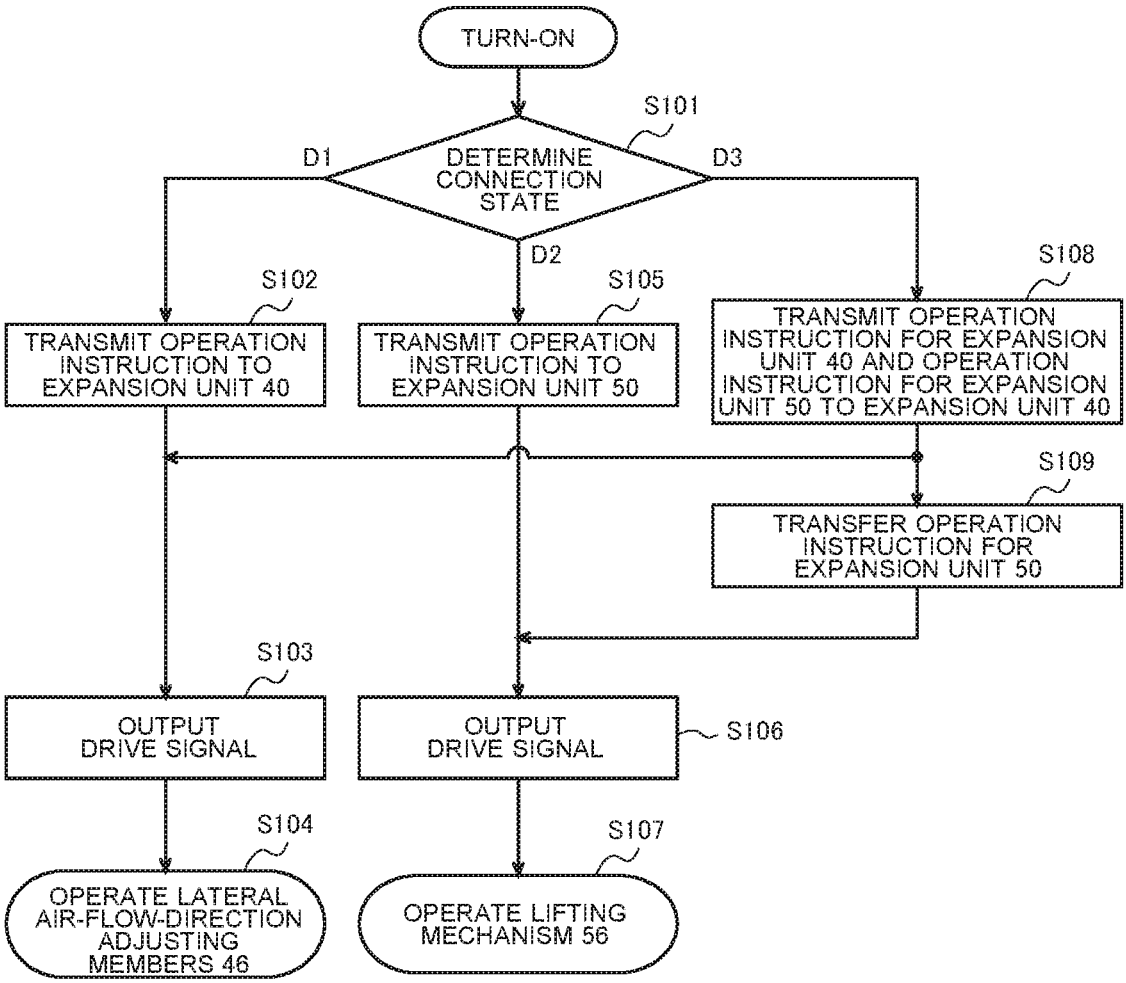
FIG. 10 is a flowchart of an operation of the indoor system at turn-on that varies in accordance with which of connection states as illustrated in FIGS. 4 to 6 is applied.

FIG. 10 is a flowchart of an operation of the indoor system at turn-on that varies in accordance with which of connection states as illustrated in FIGS. 4 to 6 is applied. The flow of the operation that is performed when driving of at least one expansion unit is controlled on the premise that the at least one expansion unit is connected will be described.

When the indoor system 100 is turned on, the connection determining unit 24*a* determines a connection state between the main body 20 and each of the expansion unit 40 and the expansion unit 50, and outputs connection-state data indicating the result of the above determination to the operation instruction unit 24*b* (step S101).

Upon of receipt of connection-state data indicating that only the expansion unit 40 is connected (see FIG. 5) from the connection determining unit 24*a* (D1 in step S101), the operation instruction unit 24*b* generates, based on the basic settings, an operation instruction to operate the expansion unit 40. Then, the operation instruction unit 24*b* transmits the generated operation instruction to the drive processing unit 44 in the expansion unit 40 (step S102). In response to the operation instruction from the operation instruction unit 24*b*, the drive processing unit 44 outputs a drive signal for designating, for example, the number of pulses, to an actuator, for example, the lateral driving motor 47 (step S103). Thus, the lateral air-flow-direction adjusting members 46 in the expansion unit 40, which is the blowing unit, are operated (step S104).

Upon of receipt of connection-state data indicating that only the expansion unit 50 is connected (see FIG. 6) from the connection determining unit 24*a* (D2 in step S101), the operation instruction unit 24*b* generates, based on the basic settings, an operation instruction to operate the expansion unit 50. The operation instruction unit 24*b* transmits the generated operation instruction to the drive processing unit 54 in the expansion unit 50 (step S105). In response to the operation instruction from the operation instruction unit 24*b*, the drive processing unit 54 outputs a drive signal for starting an initial operation to the lifting mechanism 56 (step S106). Upon receipt of the drive signal, the lifting mechanism 56 in the expansion unit 50, which is the lifting unit, is operated (step S107).

Upon receipt of connection-state data indicating that both the expansion unit 40 and the expansion unit 50 are connected (see FIG. 4), from the connection determining unit 24*a* (D3 in step S101), the operation instruction unit 24*b* generates, based on the basic settings, an operation instruction to operate the expansion unit 40 and an operation instruction to operate the expansion unit 50. Then, the operation instruction unit 24*b* transmits the operation instruction for the expansion unit 40 and the operation instruction for the expansion unit 50 to the drive processing unit 44 in the expansion unit 40 (step S108).

In response to the operation instruction for the expansion unit 40 that is transmitted from the operation instruction unit 24*b*, the drive processing unit 44 outputs a drive signal to the lateral driving motor 47 (step S103), thereby operating the lateral air-flow-direction adjusting members 46 (step S104). Furthermore, the drive processing unit 44 transfers the operation instruction for the expansion unit 50 that is transmitted from the operation instruction unit 24*b*, to the drive processing unit 54 in the expansion unit 50 (step S109). In response to the operation instruction transferred from the drive processing unit 44, the drive processing unit 54 outputs a drive signal for starting the initial operation to the lifting mechanism 56 (step S106), thereby operating the lifting mechanism 56 (step S107).

In Embodiment 1, since the lifting unit is an example of the expansion unit 50, it is also assumed that the expansion unit 50 are not operated at turn-on. Therefore, if the initial operation of the expansion unit 50 is not included in the basic settings, the operation instruction unit 24*b* will not generate an operation instruction for the expansion unit 50.

The connection determining unit 24*a* or the operation instruction unit 24*b* stores connection-state data into the storage unit 24*e* as a step in processing which is performed at turn-on, as illustrated in FIG. 10. Therefore, after turn-on, when acquiring an operation signal from the communication unit 24*c* or acquiring different information from the arithmetic unit 24*d*, the operation instruction unit 24*b* reads the connection-state data from the storage unit 24*e* and determines a system configuration. Then, the operation instruction unit 24*b* transmits an operation instruction based on the determined system configuration to the drive processing unit 44 in the expansion unit 40 or the drive processing unit 54 in the expansion unit 50.

As described above, in the indoor unit 10 in Embodiment 1, the main board 21 is connected to the expansion unit 50 via the expansion board 80. Therefore, the main board 21 does not need to have a plurality of connection terminals for connection to the expansion units. Therefore, the main board 21 is not made larger. In other words, in the indoor unit 10, even in the case of adding thereto various functions other than the basic function, it is not necessary to change the size of the main board 21. It is therefore possible to improve cost effectiveness. Furthermore, since the main board 21 is compact in size, a sufficient air passage can be secured in the casing 25. Therefore, it is possible to improve the performance of the indoor unit 10 and the quality of air-conditioning control.

To be more specific, in the indoor unit 10 in Embodiment 1, the expansion board 80 is provided in the expansion unit 40, which is one of the plurality of expansion units compatible with the control terminal 23*a*. The main board 21 is connected to the expansion unit 50 by the following connections: the wiring line 11 extending from the expansion unit 40 is connected to the control terminal 23*a*; and the wiring line 12 extending from the expansion unit 50 is connected to the expansion terminal 83 of the expansion board 80. Therefore, the main board 21 does not need to have a connection terminal for connection to the expansion unit 50. The main board 21 can be thus made compact in size. Therefore, even in the case where a plurality of expansion units are added to the indoor unit 10, the casing 25 that is a shell of the main body 20 can be made smaller, thus reducing constraints on the place where the indoor unit 10 is installed.

In the case where the wiring line 11 extending from the expansion board 80 is connected to the control terminal 23*a* and the wiring line 12 extending from the expansion unit 50 is connected to the expansion terminal 83, the controller 24 transmits an operation instruction for the expansion unit 40 and an operation instruction for the expansion unit 50 to the expansion unit 40. That is, in the indoor unit 10, in the case where the main board 21, the expansion board 80, and the standard board 51 are connected in series by the wiring lines, control signals can be transmitted from the controller 24 not only to the expansion unit 40 but to the expansion unit 50. In addition, in the case where only the expansion unit 40 is connected to the main board 21, the controller 24 transmits an operation instruction to the expansion unit 40 only. In the case where the wiring line 12 extending from the expansion unit 50 is connected to the control terminal 23*a*, the controller 24 directly transmits an operation instruction to the expansion unit 50. Therefore, the main board 21 can be made compact in size, and the expansion units can be smoothly controlled.

Furthermore, the main board 21 includes the power supply circuit 22 that supplies power to an expansion unit connected to the main board 21. For example, in the system configuration as illustrated in FIG. 4, the power supply circuit 22 supplies power to both the expansion unit 40 directly connected to the main board 21 and the expansion unit 50 indirectly connected indirectly to the main board 21. It is therefore unnecessary to provide another power supply circuit on each of the expansion board 80 and the standard board 51, thus reducing complication and enlargement of expansion units that are added to the indoor unit 10. Therefore, the entire indoor system 100 can be made smaller.

In the case where the expansion unit 40, which is the blowing unit, is attached to the indoor unit 10, the flow direction of air to be blown from the air outlets 2 can be adjusted not only in the vertical direction but in the lateral direction. It is therefore possible to further improve the quality of air-conditioning. In the case where the expansion unit 50, which is the lifting unit, is attached to the indoor unit 10, the air inlet grille 31 can be automatically moved up and down. It is therefore possible to improve user convenience. In addition, in the case where the expansion unit 60, which is the humidifier, is attached to the indoor unit 10, the humidity in the air-conditioned space can be finely adjusted. It is therefore possible to improve user comfort.

<Modification 1-1>

Although it is described above by way of example that the expansion board 80 including the expansion terminal 83 is provided in the expansion unit 40, it is not limitative. The expansion board 80 may be provided in another expansion unit. In the following, it is assumed that the expansion board 80 is provided in the expansion unit 50. A configuration and an operation different from those described above will be described.

Figure 11:
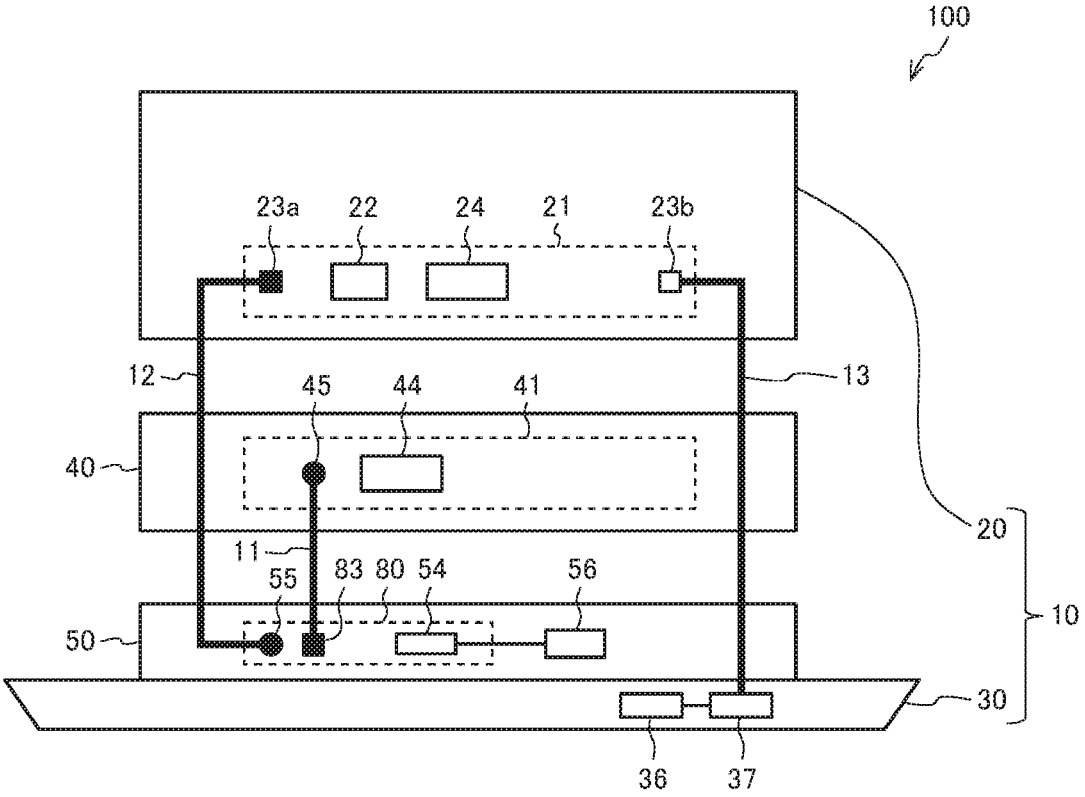
FIG. 11 is a configuration diagram of an example of an indoor system according to modification 1-1 of Embodiment 1 of the present disclosure.

FIG. 11 is a configuration diagram of an example of an indoor system according to modification 1-1 of Embodiment 1 of the present disclosure. In an example as illustrated in FIG. 11, the expansion unit 50 includes the expansion board 80 provided with the expansion terminal 83 that is compliant with the same standard as the control terminal 23*a*. The expansion unit 40 includes a standard board 41 that fulfills a standard function of the expansion unit 40. In modification 1-1, the standard function of the expansion unit 40 is a function of operating the lateral air-flow-direction adjusting members 46.

In the above configuration, the wiring line 12 extending from the input terminal 55 of the expansion unit 50 is connected to the control terminal 23*a* of the main board 21 in the main body 20. Furthermore, the wiring line 11 extending from the input terminal 45 of the expansion unit 40 is connected to the expansion terminal 83 of the expansion board 80 in the expansion unit 50. The power supply circuit 22 supplies power to the expansion unit 50 through the wiring line 12, and supplies power to the expansion unit 40 through the wiring lines 11 and 12.

Figure 12:
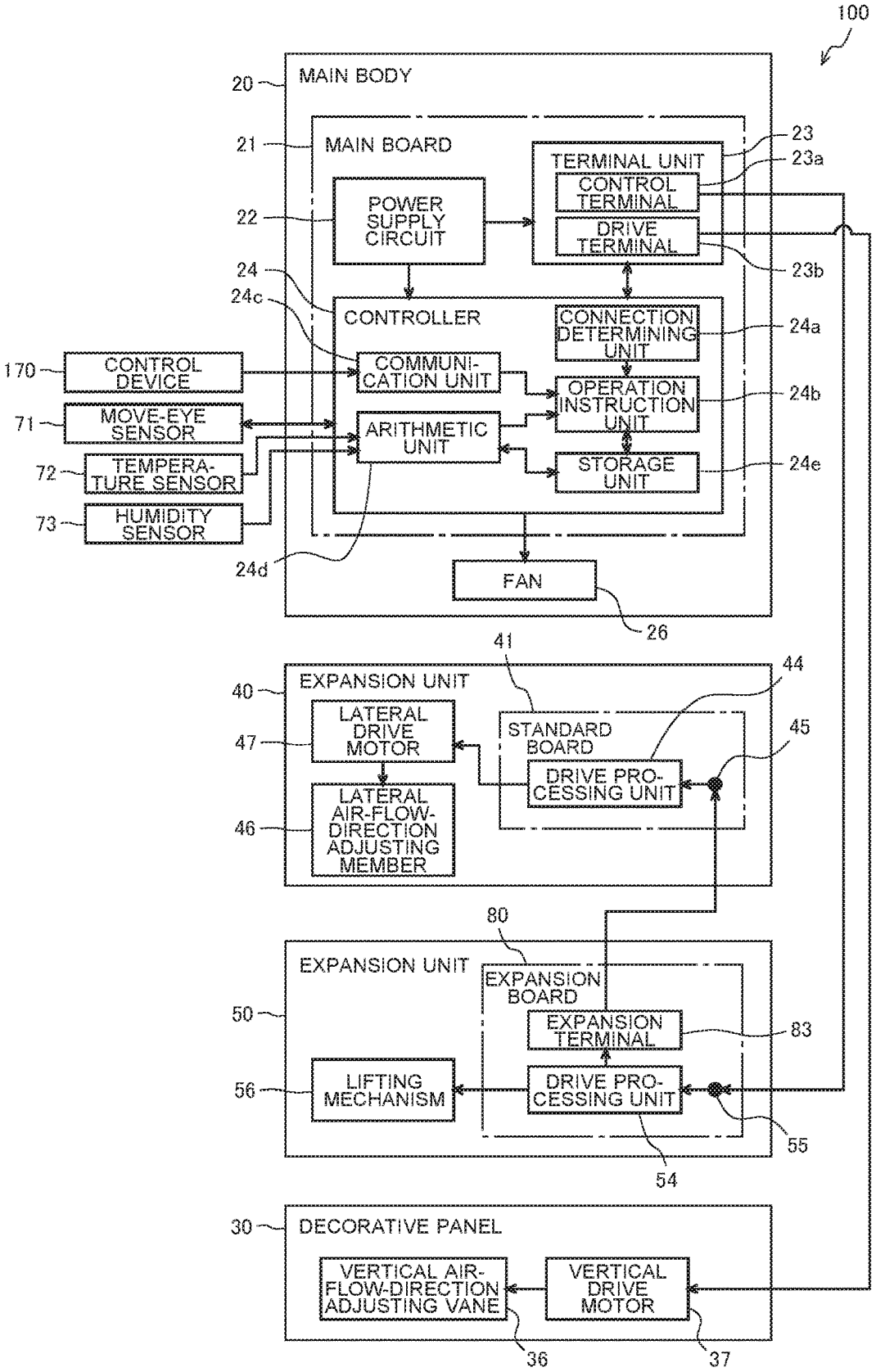
FIG. 12 is a block diagram of a functional configuration of the indoor system as illustrated in FIG. 11.

FIG. 12 is a block diagram of a functional configuration of the indoor system as illustrated in FIG. 11. To operate the lateral air-flow-direction adjusting members 46, the operation instruction unit 24*b* of modification 1-1 transmits a lateral drive signal for driving the lateral driving motor 47 to the drive processing unit 54 on the expansion board 80 via the control terminal 23*a*. The drive processing unit 54 transfers the lateral drive signal that is transmitted from the operation instruction unit 24*b*, to the drive processing unit 44 via the expansion terminal 83. To be more specific, the drive processing unit 54 of modification 1-1 has a function of determining whether an operation instruction from the controller 24 is an operation instruction for the expansion unit 40 or an operation instruction for the expansion unit 50 and transferring an operation instruction for the expansion unit 40 to the expansion unit 40. The drive processing unit 44 drives the lateral driving motor 47 in response to the lateral drive signal transmitted from the operation instruction unit 24*b* via the drive processing unit 54, thereby operating the lateral air-flow-direction adjusting members 46.

To move the air inlet grille 31 up or down, the operation instruction unit 24*b* transmits a lifting drive signal for driving the lifting mechanism 56 to the drive processing unit 54 on the expansion board 80 via the control terminal 23*a*. The drive processing unit 54 drives the lifting mechanism 56 in response to the lifting drive signal from the operation instruction unit 24*b*, thereby moving the air inlet grille 31 up or down.

As described above, the expansion board 80 in the indoor unit 10 of modification 1-1 is provided in the expansion unit 50, which is one of the plurality of expansion units compatible with the control terminal 23*a*. The main board 21 is connected to the expansion unit 40 by the following connections: the wiring line 12 extending from the expansion unit 50 is connected to the control terminal 23*a*; and the wiring line 11 extending from the expansion unit 40 is connected to the expansion terminal 83 of the expansion board 80. Therefore, the main board 21 does not need to have a connection terminal for connection to the expansion unit 40, and the main board 21 can be made compact in size. Thus, even in the case where a plurality of expansion units are added to the indoor unit 10, the casing 25 that is a shell of the main body 20 can be made smaller, thereby reducing constraints on the place where the indoor unit 10 is installed.

In the case where the wiring line 12 extending from the expansion board 80 is connected to the control terminal 23*a* and the wiring line 11 extending from the expansion unit 40 is connected to the expansion terminal 83, the controller 24 transmits an operation instruction for the expansion unit 40 and an operation instruction for the expansion unit 50 to the expansion unit 50. That is, in the indoor unit 10, in the case where the main board 21, the expansion board 80, and the standard board 41 are connected in series by the wiring lines, control signals can be transmitted from the controller 24 not only to the expansion unit 50 but to the expansion unit 40. Therefore, the main board 21 can be made compact in size, and the expansion units can be smoothly controlled.

For example, in the system configuration as illustrated in FIG. 12, the power supply circuit 22 supplies power to both the expansion unit 50 directly connected to the main board 21 and the expansion unit 40 indirectly connected to the main board 21. It is therefore unnecessary to provide another power supply circuit in each of the expansion board 80 and the standard board 41, thus reducing complication and enlargement of each of expansion units that are added to the indoor unit 10. Therefore, the entire indoor system 100 can be made smaller.

<Modification 1-2>

Although FIG. 9 illustrates by way of example the case where the expansion unit 60 is not compliant with the standard with which the control terminal 23*a* and the expansion terminal 83 are compliant, this is not limitative. In the case where an expansion unit to be added is compliant with the standard of the control terminal 23*a* and the expansion terminal 83, the expansion board 80 may be provided in each of a plurality of expansion units. Because of provision of such a configuration, even in the case where three or more expansion units are added, it is possible to reduce the number of connection terminals of the main board 21.

Figure 13:
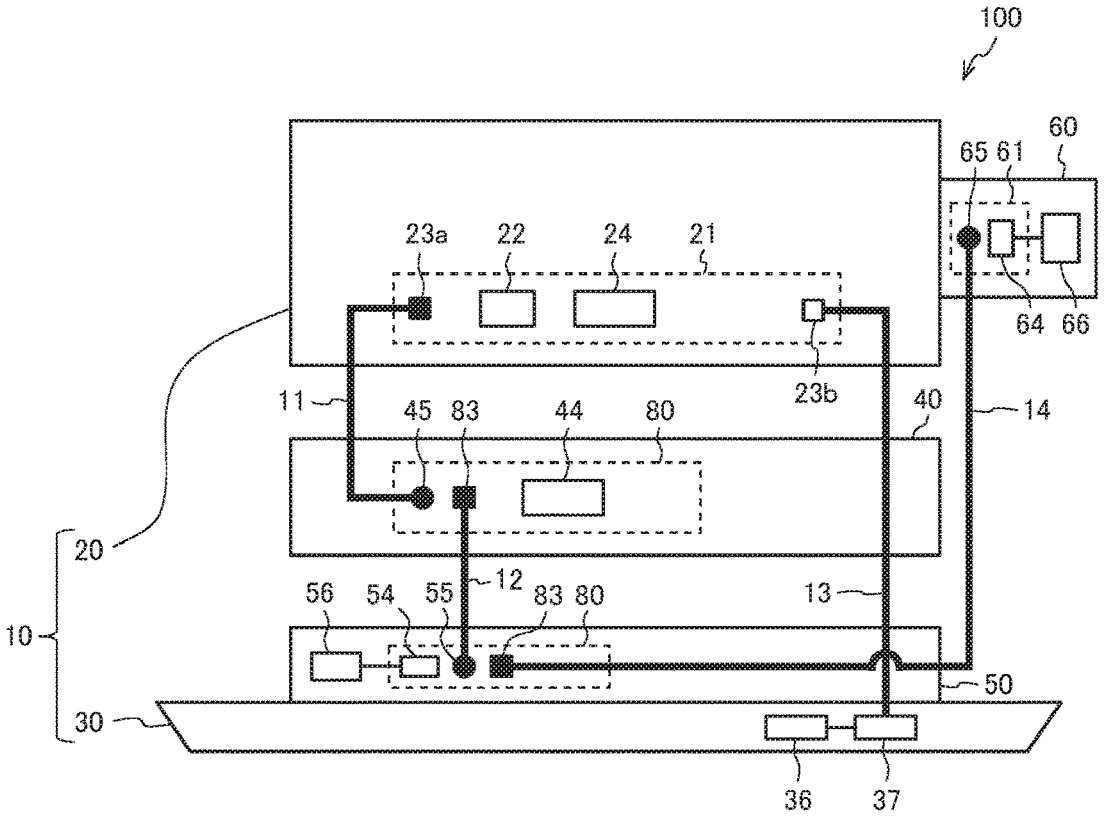
FIG. 13 is a configuration diagram of an example of an indoor system according to modification 1-2 of Embodiment 1 of the present disclosure.

FIG. 13 is a configuration diagram of an example of an indoor system according to modification 1-2 of Embodiment 1 of the present disclosure. In modification 1-2, it is assumed that the expansion unit 60 is compliant with the standard of the control terminal 23*a* and the expansion terminal 83. A configuration and operation different from those described above will be described.

FIG. 13 illustrates by way of example the case where the expansion board 80 provided with the expansion terminal 83 compliant with the same standard as the control terminal 23*a* is provided in each of the expansion unit 40 and the expansion unit 50. The expansion board 80 in the expansion unit 50 has a relay function of transferring an operation instruction from the controller 24 to the expansion unit 60 in addition to the same function as the above standard board 51. The wiring line 14 extending from the input terminal 65 of the expansion unit 60 is connected to the expansion terminal 83 of the expansion board 80 in the expansion unit 50. The power supply circuit 22 supplies power to the expansion unit 60 through the wiring lines 11, 12, and 14.

The connection determining unit 24*a* of modification 1-2 determines a connection state between the main body 20 and each of the expansion unit 40, the expansion unit 50, and the expansion unit 60 at turn-on, and outputs connection-state data indicating the result of the determination to the operation instruction unit 24*b*.

In the case of operating the expansion unit 60, the operation instruction unit 24*b* of modification 1-2 transmits a humidification drive signal to the drive processing unit 44 on the expansion board 80 via the control terminal 23*a*. The drive processing unit 44 transfers the humidification drive signal transmitted from the operation instruction unit 24*b* to the drive processing unit 44 in the expansion unit 50 via the expansion terminal 83. The drive processing unit 54 transmits the humidification drive signal transferred from the drive processing unit 54 to the drive processing unit 64 in the expansion unit 60 via the expansion terminal 83. In response to the humidification drive signal transmitted from the operation instruction unit 24*b* via the drive processing unit 44 and the drive processing unit 54, the drive processing unit 64 drives the humidifying mechanism 66, thereby adjusting the humidity of air that is blown into the room.

The number of expansion units connected in series to the indoor unit 10 is not limited to three. The indoor unit 10 may be connected in series to four or more expansion units. In the case where some of the expansion units include respective expansion boards 80, the main board 21 is connected to the expansion units including the respective expansion boards 80 via the expansion boards 80 by the following connections: a wiring line extending from one of the expansion boards 80 is connected to the control terminal 23*a*; and the expansion boards 80 are connected in series. In such a configuration, in the case where an expansion unit including no expansion board 80 is attached to the indoor unit 10, the expansion boards 80 and a standard board are connected in series, whereby the main board 21 is connected to the expansion unit including no expansion board 80. In the example as illustrated in FIG. 13, the two expansion boards 80 and the standard board 61 are connected in series, whereby the main board 21 is connected to the expansion unit including no expansion board 80. The controller 24 transmits operation instructions for the expansion units including respective expansion boards 80 and an operation instruction for the expansion unit including no expansion board 80 to the expansion unit including the expansion board 80 connected to the control terminal 23*a*.

As described above, in the indoor unit 10 according to modification 1-2, in the case where the main board 21 is connected in series to the two expansion boards 80 and the standard board 51 by the wiring lines, control signals can be transmitted from the controller 24 not only to the expansion unit 40 but to the expansion units 50 and 60. Therefore, the main board 21 can be made compact in size, and the expansion units can be smoothly controlled.

The configuration of modification 1-1 as described above can also be applied to the indoor unit 10 and the indoor system 100 in modification 1-2. That is, the main body 20 may be connected to the expansion unit 50, the expansion unit 50 may be connected to the expansion unit 40, and the expansion unit 40 may be connected to the expansion unit 60. Furthermore, if the expansion unit 60 is made to have a relay function by, for example, replacing the standard board 61 by the expansion board 80, it is possible to further obtain another system configuration.

<Modification 1-3>

Although FIG. 9 illustrates by way of example the case where the expansion unit 60 is not compliant with the standard of the control terminal 23*a* and the expansion terminal 83, this is not limitative. In the case where an expansion unit to be added is compliant with the standard of the control terminal 23*a* and the expansion terminal 83, it is possible to reduce the number of connection terminals of the main board 21 by increasing the number of expansion terminals 83 provided in the expansion board 80, even in the case where three or more expansion units are added.

Figure 14:
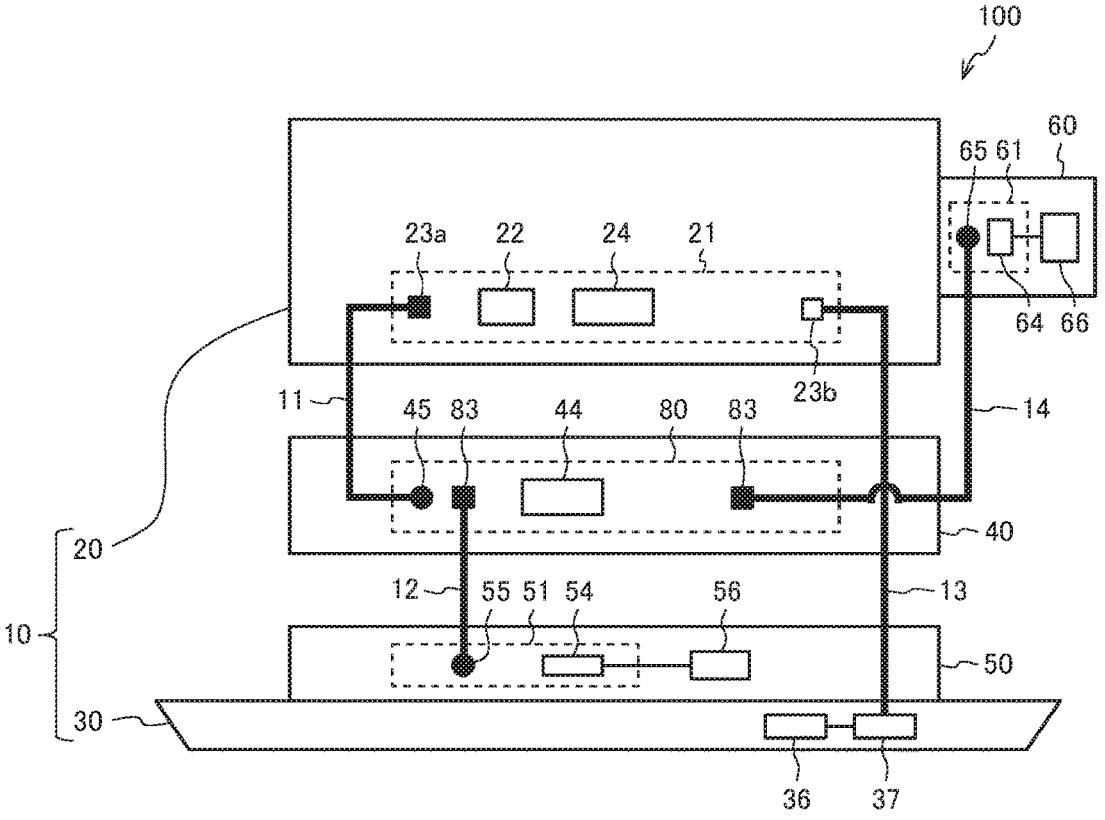
FIG. 14 is a configuration diagram of an example of an indoor system according to modification 1-3 of Embodiment 1 of the present disclosure.

FIG. 14 is a configuration diagram of an example of an indoor system according to modification 1-3 of Embodiment 1 of the present disclosure. In modification 1-3, it is assumed that the expansion unit 60 is compliant with the standard of the control terminal 23*a* and the expansion terminal 83. A configuration and operation different from those described above will be described.

The expansion board 80 of modification 1-3 includes two expansion terminals 83. The wiring line 12 extending from the input terminal 55 of the expansion unit 50 is connected to one of the expansion terminals 83, and the wiring line 14 extending from the input terminal 65 of the expansion unit 60 is connected to the other second expansion terminal 83. The power supply circuit 22, therefore, supplies power to the expansion unit 60 through the wiring lines 11 and 14.

In the case of operating the expansion unit 60, the operation instruction unit 24*b* transmits a humidification drive signal to the drive processing unit 44 on the expansion board 80 via the control terminal 23*a*. The drive processing unit 44 transmits the humidification drive signal transmitted from the operation instruction unit 24*b* to the drive processing unit 64 via the above other expansion terminal 83. In response to the humidification drive signal transmitted from the operation instruction unit 24*b* via the expansion board 80, the drive processing unit 64 drives the humidifying mechanism 66, thereby adjusting the humidity of air that is blown into the room.

Although FIG. 14 illustrates by way of example the case where the three expansion units are added to the indoor unit 10, this is not limitative. Four or more expansion units may be added to the indoor unit 10. To be more specific, in the expansion board 80, three or more expansion terminals 83 may be provided, and the expansion terminals 83 may be connected to respective expansion units. The expansion unit including the expansion board 80 may be changed as appropriate based on a usage condition, for example, the frequency with which the expansion unit is used as an optional component.

As described above, in the indoor unit 10 according to modification 1-3, the controller 24 generates an operation instruction for each of the expansion units connected to the main body 20 and transmits the operation instruction to each expansion unit via the control terminal 23*a*. It is therefore unnecessary to provide the control terminal 23*c* as illustrated in FIG. 9. Thus, the main board 21 is not made larger even in the case where three or more expansion units are added.

Embodiment 2

With respect to Embodiment 1, although it is described above by way of example that the expansion board 80 is provided in the expansion unit, it is not limitative. An indoor system according to Embodiment 2 is featured in that the expansion board 80 is provided in the main body 20. Regarding Embodiment 2, components that are the same as or equivalent to those in Embodiment 1 will be denoted by the same reference signs, and their descriptions will thus be omitted.

Figure 15:
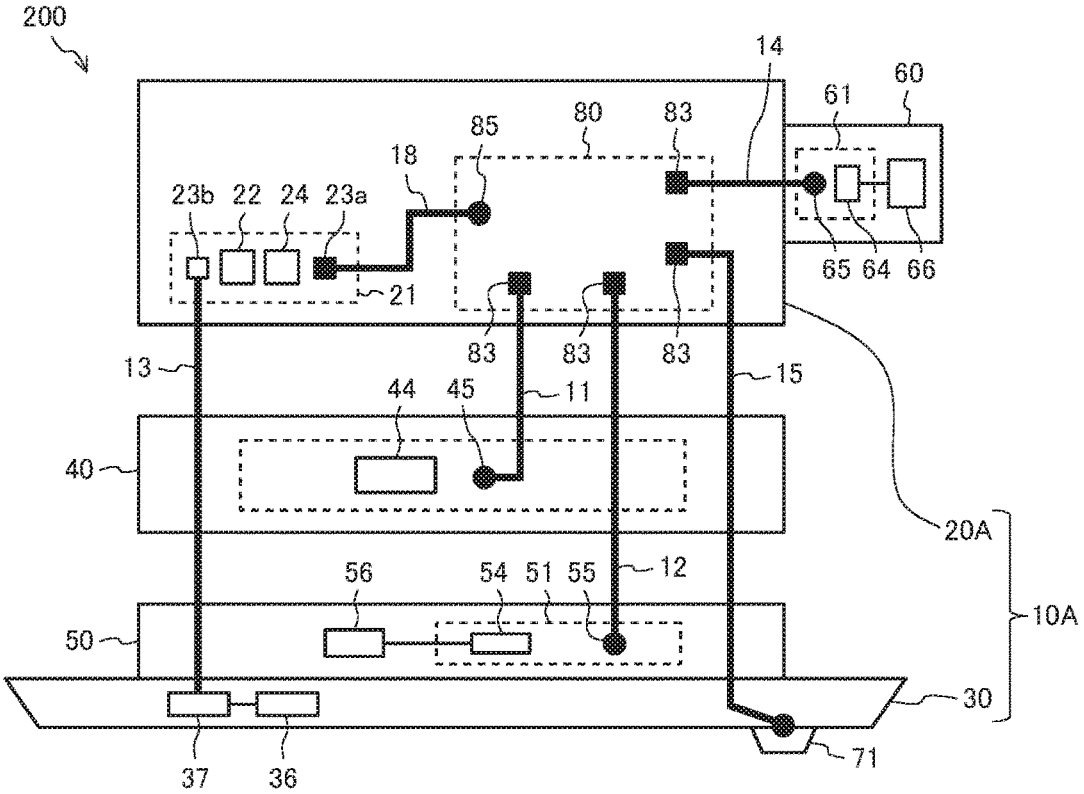
FIG. 15 is a configuration diagram of an example of an indoor system and an indoor unit of an air-conditioning apparatus according to Embodiment 2 of the present disclosure.

FIG. 15 is a configuration diagram of an example of an indoor system and an indoor unit of an air-conditioning apparatus according to Embodiment 2 of the present disclosure. In an example as illustrated in FIG. 15, an indoor system 200 includes an indoor unit 10A including a main body 20A and the decorative panel 30, the expansion unit 40, the expansion unit 50, the expansion unit 60, and the Move-Eye sensor 71 as an expansion unit for the indoor unit 10A.

The main body 20A has an expansion board 80 including a plurality of expansion terminals 83 compliant with the same standard as the control terminal 23*a*. In the example as illustrated in FIG. 15, the expansion board 80 includes four expansion terminals 83 and an input terminal 85, and the number of the expansion terminals 83 is equal to that of the expansion units. The control terminal 23*a* is connected to the input terminal 85 by a wiring line 18. In other words, the wiring line 18 extending from the input terminal 85 of the expansion board 80 is connected to the control terminal 23*a*.

It is assumed that the expansion units 40, 50, and 60 and the Move-Eye sensor 71 are compliant with the standard of the control terminal 23*a* and the expansion terminals 83. Therefore, the wiring line 11 extending from the expansion unit 40, the wiring line 12 extending from the expansion unit 50, the wiring line 14 extending from the expansion unit 60, and a wiring line 15 extending from the Move-Eye sensor 71 are connected to respective expansion terminals 83.

The connection determining unit 24*a* in Embodiment 2 detects, at turn-on, whether or not the main body 20A is connected to each of two or more expansion units. In the configuration as illustrated in FIG. 15, the connection determining unit 24*a* determines a connection state between the main body 20A and each of the expansion unit 40, the expansion unit 50, the expansion unit 60, and the Move-Eye sensor 71, and outputs connection-state data indicating the result of the determination to the operation instruction unit 24*b*. The operation instruction unit 24*b* transmits an operation instruction to each of the expansion unit 40, the expansion unit 50, the expansion unit 60, and the Move-Eye sensor 71 via an associated one of the control terminal 23*a* and the expansion terminals 83. That is, when detecting an expansion unit connected via the expansion board 80, the controller 24 transmits an operation instruction to the detected expansion unit via the expansion board 80.

The power supply circuit 22 supplies power to the expansion unit 40, the expansion unit 50, the expansion unit 60, and the Move-Eye sensor 71 through the wiring line 18 and respective wiring lines, that is, to the expansion unit 40, the expansion unit 50, the expansion unit 60, and the Move-Eye sensor 71 through the wiring lines 18 and 11, the wiring lines 18 and 12, the wiring lines 18 and 14, and the wiring lines 18 and 15, respectively.

Although FIG. 15 illustrates by way of example the case where the four expansion units are attached to the indoor unit 10A, this is not limitative. To the indoor unit 10A, one, two or three expansion units may be attached, or five or more expansion units may be attached. In other words, although FIG. 15 illustrates by way of example the case where the four expansion terminals 83 are provided in the expansion board 80, this is not limitative, and in the expansion board 80, three or less expansion terminals 83 may be provided, or five or more expansion terminals 83 may be provided.

As described above, in the indoor unit 10A in Embodiment 2, the main board 21 can be connected to a plurality of expansion units via the expansion board 80. Therefore, the main board 21 does not need to have a plurality of control terminals 23*a* for connection to the respective expansion units. Therefore, the main board 21 is not made larger, and the cost effectiveness can be improved.

The expansion board 80 is removably provided in the main body 20A. To be more specific, even in the case where a plurality of expansion units are attached to the indoor unit 10A, if the expansion board 80 is added to the indoor unit 10A, it is not necessary to change the size of the main board 21. In the case where an expansion unit is not attached to the indoor unit 10A, the expansion board 80 is not added to the indoor unit 10A, whereby an air passage in the casing 25 can be expanded. That is, since the size of the main board 21 is not increased, the cost effectiveness is improved. In addition, since a sufficient air passage can be ensued in the casing 25, the performance of the indoor unit 10A can be improved.

The main board 21 is connected to one or more expansion units via the expansion board 80 by the following connections: the wiring line extending from the expansion board 80 is connected to the control terminal 23*a*; and a wiring line or wiring lines extending from the one or more expansion units are connected to the expansion terminals 83. Therefore, regarding the control terminal 23*a*, it suffices that the main board 21 is provided with only one control terminal 23*a*. Thus, the main board 21 can be made compact in size.

When detecting an expansion unit connected via the expansion board 80, the controller 24 transmits an operation instruction to the detected expansion unit via the expansion board 80. That is, in the indoor unit 10A, a control signal can be transmitted from the controller 24 to one or more expansion units via the expansion board 80. Therefore, the expansion units can be smoothly controlled.

<Modification 2-1>

Figure 16:
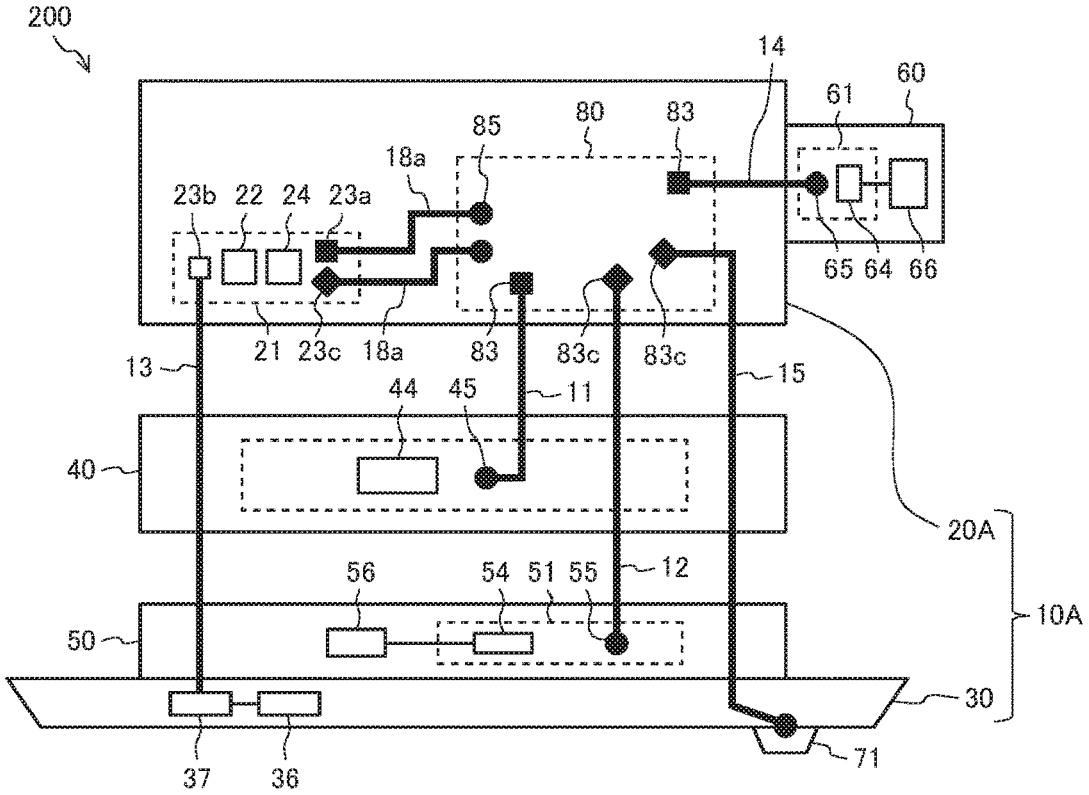
FIG. 16 is a configuration diagram of an example of an indoor system and an indoor unit of an air-conditioning apparatus according to modification 2-1 of Embodiment 2 of the present disclosure.

FIG. 16 is a configuration diagram of an example of an indoor system and an indoor unit of an air-conditioning apparatus according to modification 2-1 of Embodiment 2 of the present disclosure. In modification 2-1, it is assumed that at least two of a plurality of expansion units are not compliant with the standard of the control terminal 23*a*. FIG. 16 illustrates by way of example the case where the expansion unit 40 and the expansion unit 60 are compliant with the standard of the control terminal 23*a*, but the expansion unit 50 and the Move-Eye sensor 71 are not compliant with the standard of the control terminal 23*a*. It is further assumed that the expansion unit 50 and the Move-Eye sensor 71 are compliant with the same standard as the connection terminal.

In the example as illustrated in FIG. 16, the main board 21 includes the control terminal 23*c*, and the expansion board 80 includes two expansion terminals 83, two expansion terminals 83*c*, and the input terminal 85. The two expansion terminals 83*c* are connection terminals compliant with the same standard as the control terminal 23*c*. The wiring line 12 extending from the expansion unit 50 is connected to one of the expansion terminals 83*c*, and the wiring line 15 extending from the Move-Eye sensor 71 is connected to the other expansion terminal 83*c*.

Although FIG. 16 illustrates by way of example the case where the four expansion units are attached to the indoor unit 10A, this is not limitative. To the indoor unit 10A, one to three expansion units may be attached, or five or more expansion units may be attached. In other words, although FIG. 16 illustrates by way of example the case where the main board 21 includes the control terminal 23*a* and the control terminal 23*c*, and the expansion board 80 includes the two expansion terminals 83 and the two expansion terminals 83*c*, this is not limitative. It is appropriate that the number of control terminals of the main board 21, the number of expansion terminals of the expansion board 80, and the combination of types of terminals are adjusted based on the combination of expansion units, that is, the compatibility of each of the expansion units with the connection terminals.

As described above, also, in the indoor unit 10A according to modification 2-1, the number of control terminals provided in the main board 21 can be reduced to the minimum. Therefore, the main board 21 is not made larger, and the cost effectiveness is improved.

Embodiment 3

Figure 17:
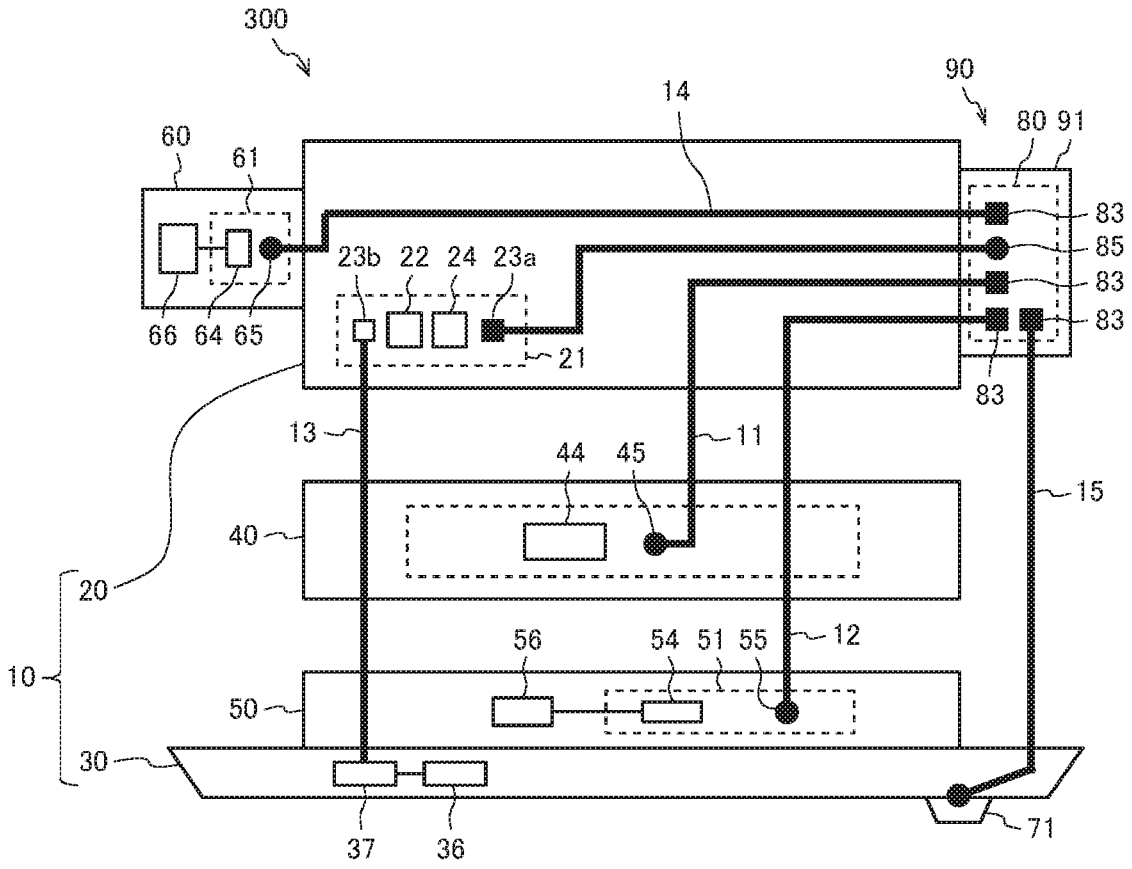
FIG. 17 is a configuration diagram of an example of an indoor system and an indoor unit of an air-conditioning apparatus according to Embodiment 3 of the present disclosure.

FIG. 17 is a configuration diagram of an example of an indoor system and an indoor unit of an air-conditioning apparatus according to Embodiment 3 of the present disclosure. Regarding Embodiment 3, components that are the same as or equivalent to those in Embodiments 1 and 2 as described above will be denoted by the same reference signs, and their descriptions will thus be omitted.

As illustrated in FIG. 17, an indoor system 300 according to Embodiment 3 includes a board unit 90 including the expansion board 80 and a board case 91. To be more specific, in the indoor system 300, the board case 1 houses the expansion board 80, which is provided in the main body 20A in Embodiment 2. The board unit 90 in Embodiment 3 is removably provided in the main body 20.

As described above, in the indoor system 300 according to Embodiment 3, the main board 21 can be connected to a plurality of expansion units via the expansion board 80 provided in the board unit 90 externally attached to the main body 20. Therefore, the main board 21 does not need to have a plurality of control terminals 23*a* for connection to the respective expansion units. Therefore, the main board 21 is not made larger, and the cost effectiveness is improved. Furthermore, even if the configuration of modification 2-1 is applied to Embodiment 3, the number of terminals provided in the main board 21 can be reduced to the minimum. Thus, the main board 21 is not made larger, and the cost effectiveness can be improved. It should be noted that the board unit 90 may be detachably attached to the decorative panel 30.

The above embodiments are preferred concrete examples of the indoor system and the indoor unit of the air-conditioning apparatus, and are not intended to limit the technical scope of the present disclosure. For example, although FIGS. 1 to 3 illustrate by way of example a ceiling-concealed four-way cassette type of indoor unit, this is not limitative. The indoor unit according to each of the above embodiments may be of a ceiling-concealed two-way cassette type or of a ceiling-concealed one-way cassette type. Furthermore, the indoor unit according to each of the above embodiments is not limited to the ceiling concealed type indoor unit, and a wall-mounted indoor unit or a floor-standing indoor unit may be used as the indoor unit according to each of the above embodiments.

Although the blowing unit, the lifting unit, the direct-contact humidifier, and the Move-Eye sensor 71 are described as examples of the expansion units added to the indoor unit in the above embodiments, the expansion units are not limited to those examples. Various devices, such as an automatic filter cleaning unit, an air outlet shutter plate, a high-powered deodorizing filter, and a wireless light-receiving kit, can be used as expansion units to be added to the indoor unit according to each of the above embodiments.

The invention claimed is:

1. An indoor unit of an air-conditioning apparatus, comprising:

a main body including a main board that is provided with a control terminal compatible with a plurality of expansion components, wherein the main board is directly connected to an expansion board provided with at least one expansion terminal that is a connection terminal compliant with the same standard as the control terminal, and is indirectly connected to at least one of the plurality of expansion components via the expansion board, wherein in a case where one of the plurality of expansion components, excluding the at least one of the plurality of expansion components, includes the expansion board, a wiring line extending from the expansion board is connected to the control terminal, and a wiring line extending from the at least one of the plurality of expansion components that includes no expansion board is connected to the at least one expansion terminal, whereby the main board is connected to the at least one of the plurality of expansion components that includes no expansion board via the expansion board, wherein in the at least one of the plurality of expansion components that includes no expansion board, a standard board configured to fulfill a standard function of the at least one of the plurality of expansion components that includes no expansion board is provided, and wherein the main board includes a power supply circuit configured to supply power to the expansion board directly connected to the main board and each of the at least one expansion component indirectly connected to the main board.

2. The indoor unit of the air-conditioning apparatus of claim 1, wherein in a case where some of the plurality of expansion components include respective expansion boards including the expansion board, the expansion boards are connected in series, whereby the main board is connected to the plurality of expansion components via the expansion boards.

3. The indoor unit of the air-conditioning apparatus of claim 1, wherein the main board includes a controller configured to detect whether or not the main body is connected to each of the plurality of expansion components, and wherein in a case where the wiring line extending from the expansion board is connected to the control terminal and the wiring line extending from the at least one of the plurality of expansion components that includes no expansion board is connected to the at least one expansion terminal, the controller transmits an operation instruction for the expansion component including the expansion board and an operation instruction for the at least one of the plurality of expansion components that includes no expansion board to the expansion component including the expansion board connected to the control terminal.

4. The indoor unit of the air-conditioning apparatus of claim 1, wherein the expansion board is removably provided in the main body.

5. The indoor unit of the air-conditioning apparatus of claim 1, wherein the main board includes a controller configured to detect whether or not the main body is connected to each of two or more of the plurality of expansion components, and wherein when detecting one of the plurality of expansion components that is connected via the expansion board, the controller transmits an operation instruction to the detected expansion component via the expansion board.

6. An indoor system comprising:

the indoor unit of the air-conditioning apparatus of claim 1; and a board unit including a board case, wherein the expansion board is housed in the board case.

* * * * *